US008418607B2

(12) United States Patent
Kachkovsky

(10) Patent No.: US 8,418,607 B2
(45) Date of Patent: Apr. 16, 2013

(54) WASTE COMPACTION AND LIFT GATE MECHANISM

(76) Inventor: Oliver Kachkovsky, Ormond Beach, FL (US)

( * ) Notice: Subject to any disclaimer, the term of this patent is extended or adjusted under 35 U.S.C. 154(b) by 367 days.

(21) Appl. No.: 12/877,825

(22) Filed: Sep. 8, 2010

(65) Prior Publication Data

US 2011/0056393 A1 Mar. 10, 2011

Related U.S. Application Data

(60) Provisional application No. 61/276,252, filed on Sep. 10, 2009.

(51) Int. Cl.

| | |
|---|---|
| ***B30B 15/14*** | (2006.01) |
| ***B30B 15/30*** | (2006.01) |
| ***B30B 1/10*** | (2006.01) |

(52) U.S. Cl.

USPC ..... 100/45; 100/215; 100/229 A; 100/281; 100/289; 100/345; 100/245

(58) Field of Classification Search ..... 100/43, 100/99, 345, 214, 215, 229 A, 245, 280, 281, 100/283, 287, 289, 45

See application file for complete search history.

(56) References Cited

U.S. PATENT DOCUMENTS

| | | | | | |
|---|---|---|---|---|---|
| 3,842,729 | A | * | 10/1974 | Mandrup | 100/229 A |
| 4,011,810 | A | * | 3/1977 | Santic | 100/229 A |
| 4,054,087 | A | * | 10/1977 | Choate et al. | 100/347 |
| 4,054,088 | A | * | 10/1977 | Nee | 100/214 |
| 4,100,850 | A | * | 7/1978 | Wolbrink et al. | 100/287 |
| 4,275,651 | A | * | 6/1981 | Groth et al. | 100/229 A |
| 4,548,132 | A | * | 10/1985 | Moon | 100/52 |
| 5,642,662 | A | * | 7/1997 | Schwelling | 100/245 |
| 5,690,025 | A | * | 11/1997 | Hawkins | 100/35 |
| 6,367,377 | B1 | * | 4/2002 | Gawley et al. | 100/49 |
| 6,925,928 | B2 | * | 8/2005 | Fox | 100/48 |
| 7,415,925 | B2 | * | 8/2008 | Fox | 100/233 |

* cited by examiner

*Primary Examiner* — Jimmy T Nguyen

(74) *Attorney, Agent, or Firm* — Sinorica, LLC

(57) ABSTRACT

A waste bin with an automated waste compaction mechanism and a automated gate lifting mechanism for convenience usage. The present invention makes use of sensors and switches to allow the compaction and gate mechanism to operate automatically. The unique combination of components also ensures the reliability of the mechanism.

19 Claims, 22 Drawing Sheets

WASTE COMPACTION AND LIFT GATE MECHANISM

The current application claims a priority to the U.S. Provisional Patent application Ser. No. 61/276,252 filed on Sep. 10, 2009.

FIELD OF THE INVENTION

The present invention relates generally to a device used to collect trash. More specifically, the trash collecting device further comprises of an automated compaction device and an automated gate lifting mechanism.

BACKGROUND OF THE INVENTION

Typically, the amount, the density, and the other characteristics of waste vary across different industries. Wastes that possess the highest air content can easily benefit the use of trash compaction. In settings such as fast food restaurants, traditional waste bins are easily filled and require the emptying and replacement of the waste receptacle. However, the waste bins are often filled with trashes that have high air content such as cup, boxes, and other containers that retain their structure. With a trash compacting device, fewer trips to the waste bins are necessary to empty the trash and replace the waste receptacle. This allows for a more streamlined waste processing routine for employees. The less frequent trips for waste processing allow for employees to attend to different issues or matters. This means less time is spent dealing with waste and more time is spent to help customers or other duties. The use of trash compactors can also benefit sanitation and rodent control. With compacted trash, less waste is scattered and is neatly disposed of. Additionally, the trash compactor prevents rodents from rummaging in loose waste looking for foods.

Traditional waste bins have openings in which users can dispose of their waste into. The hinged gate helps prevent escaping odors, but it requires users to push the gate open to dispose of waste. With frequent disposal of waste, the hinged gate slowly becomes unsanitary. Furthermore, the possibility of having ones fingers caught between the gate and the waste bin wall is present and may cause potential injuries.

The present invention is able to overcome the inconveniences of frequent trips to the waste bin for emptying and the need to manually open a gate for disposal of waste. The present invention introduces a new type of waste bin that possesses an automated trash compactor and an automated gate lifting devices. The automated trash compactor is able to periodically compact trash depending on the number of times the gate is lifted. The trash compactor also makes use of a unique compacting platen that ensures the compactor mechanics are not contaminated by the wastes. The automated gate lifting device is able to lift the gate as it detects the presence of a user for the disposal of waste.

DETAIL DESCRIPTIONS OF THE INVENTION

All illustrations of the drawings are for the purpose of describing selected versions of the present invention and are not intended to limit the scope of the present invention. The present invention is a waste compacting device with automated gate lifting abilities.

Figure 1:
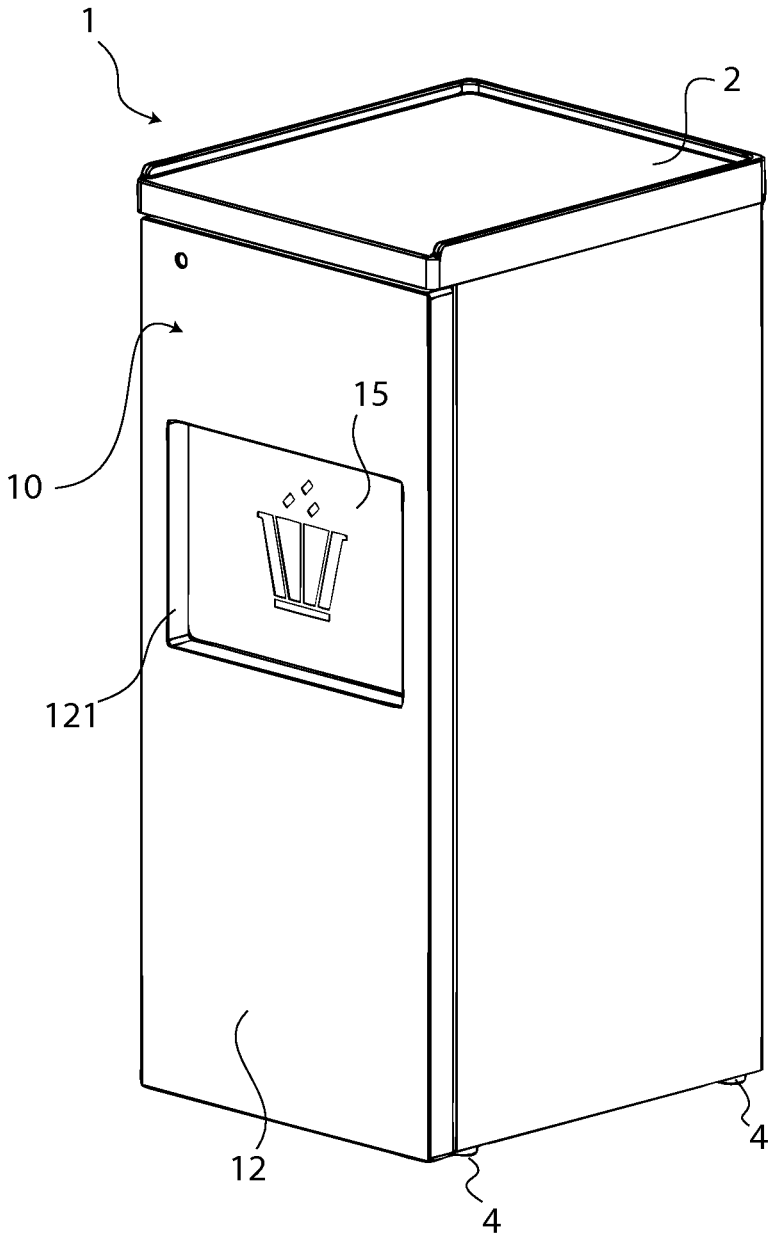
FIG. 1 is a perspective view of the present invention with the front door in a closed position.
Figure 2:
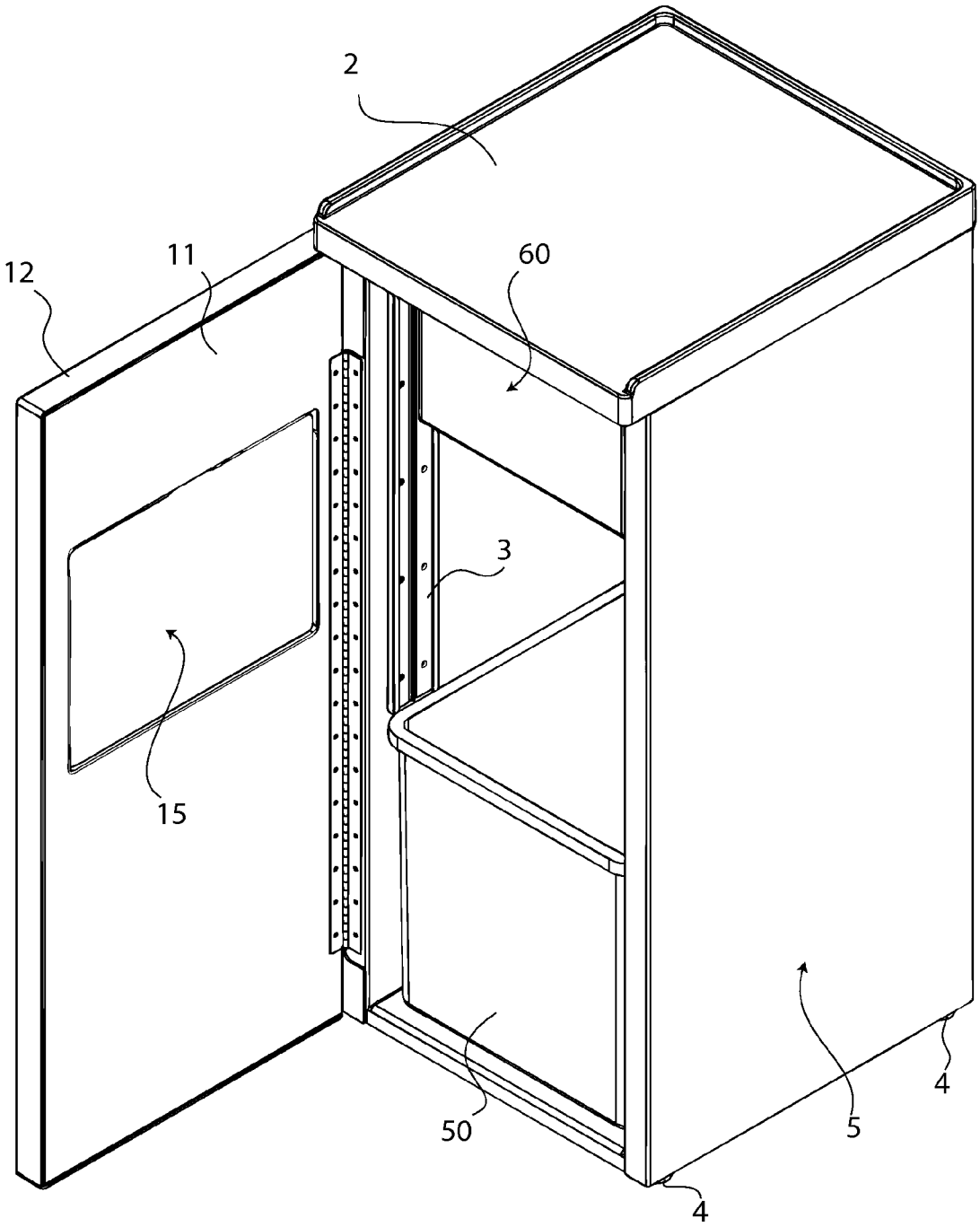
FIG. 2 is a perspective view of the present invention with the front door in an open position.
Figure 4:
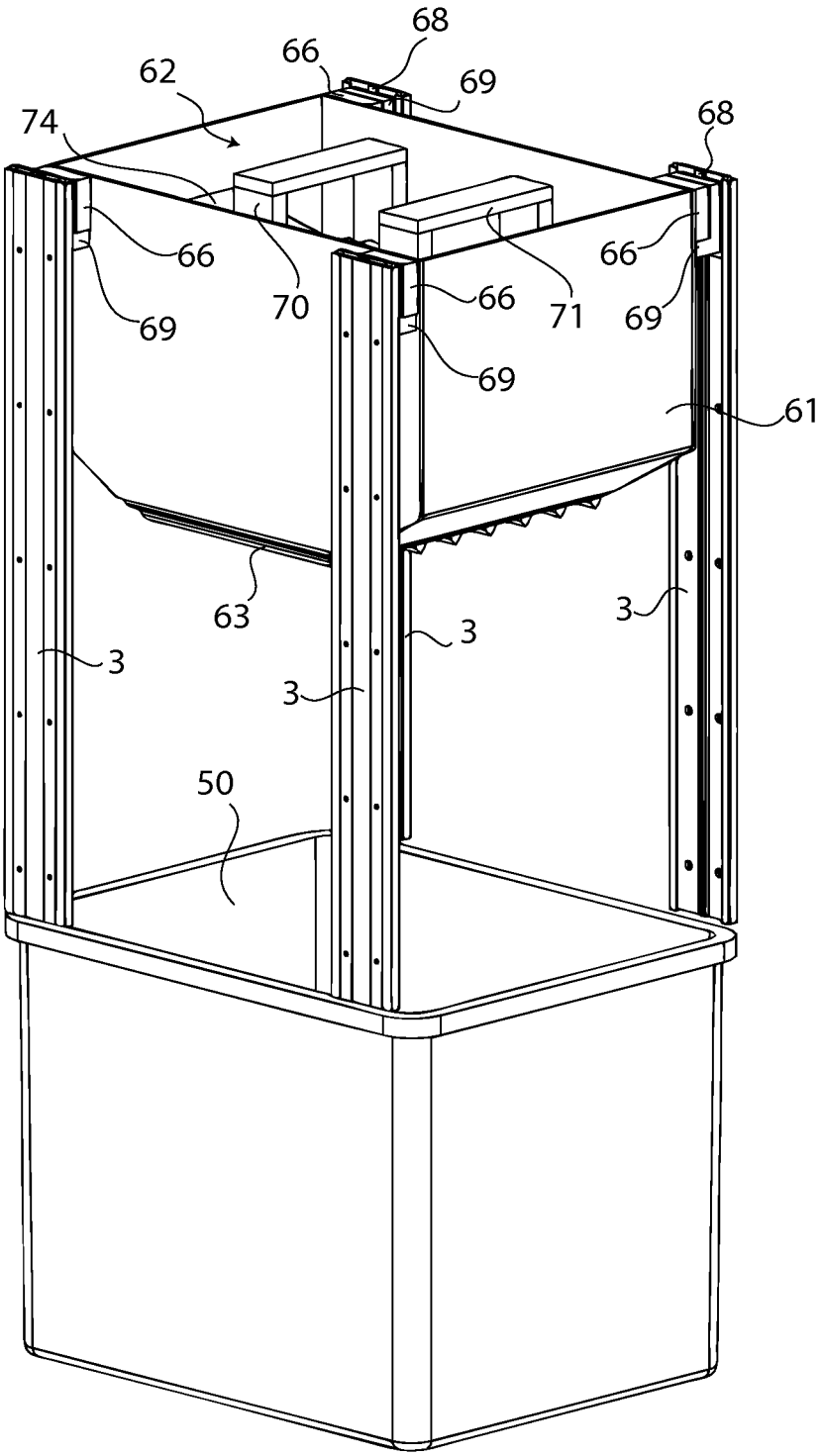
FIG. 4 is a perspective view of the present invention without the compactor enclosure exposing the linear guide rails, the compacting mechanism, and the waste receptacle. The compacting mechanism is in a retracted position.

In reference to FIG. 1, FIG. 2 and FIG. 4, the present invention comprises an external body 1, a waste receptacle 50, and a compacting mechanism 60. The external body 1 of the present invention defines the waste bin for the collection of the waste. The external body 1 is the main body of the present invention and acts as a frame to hold all of the components. The waste receptacle 50 is a removable container that is position in the external body 1 that waste is stored in for compaction and disposal. The compacting mechanism 60 is positioned within the external body 1 above the trash receptacle.

Figure 3:
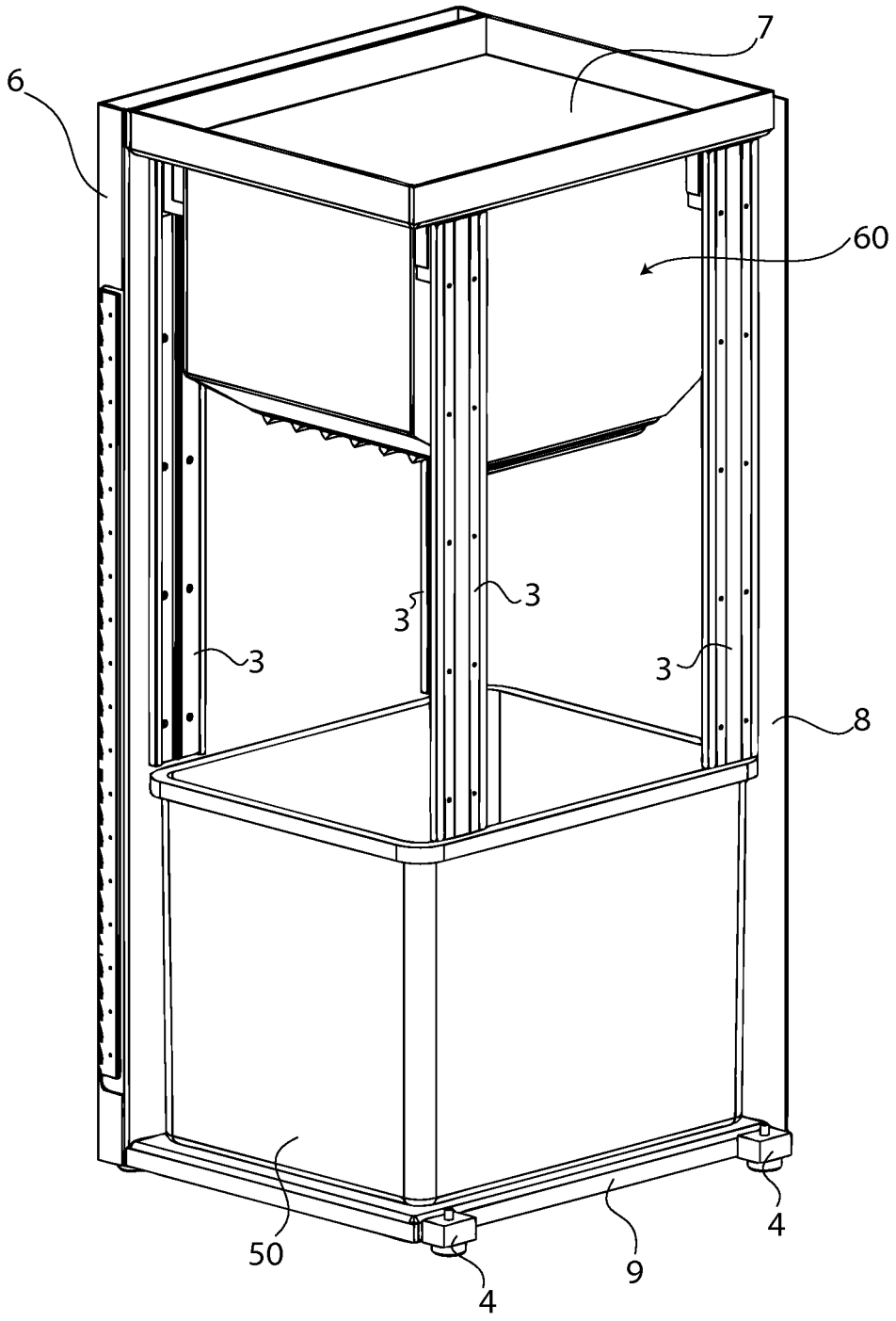
FIG. 3 is a perspective view of the present invention without the front door and one of the side walls exposing the waste receptacle and the compacting mechanism.

In reference to FIG. 1-3, the external body 1 comprises a tray holder 2, linear guide rails 3, leveling feet 4, a compactor enclosure 5, and a front door 10. The compactor enclosure 5 comprises side walls 6, a top wall 7, a rear wall 8, and a bottom wall 9. The side walls 6 are connected to both the right side and the left side of the rear wall 8 in a perpendicular relationship. The side walls 6 and the rear wall 8 both possess the same height. On the top side of the rear wall 8 and the side walls 6 are connected the top wall 7. On the bottom side of the rear wall 8 and the side walls 6 are connected the bottom wall 9. The side walls 6, the rear wall 8, the top wall 7, and the bottom wall 9 define the chamber in which waste is disposed in. The linear guide rails 3 are positioned and connected to the side walls 6 along the front and rear corners in a vertical fashion. In the preferred embodiment of the present invention, there are four linear guide rails 3 positioned on the upper half of the four corners of the waste chamber. The leveling feet 4 are connected to the corners of the bottom wall 9 and serve to elevate the present invention. The front door 10 is jointly attached to one of the side walls 6 by means of a hinge. The front door 10 encloses the waste chamber, but can be opened to expose the entire waste chamber for the extraction of the waste receptacle 50. On top of the top wall 7 is connected a tray holder 2. In fast food restaurants, after customers are finished with their meals, they are able to dispose of their waste in the bin and place their trays on the tray holder 2 positioned on the top surface of the present invention.

In reference to FIG. 5-13, the compacting mechanism 60 comprises a platen 61, an upper linear actuator bracket 70, an upper arms bracket 71, a middle bracket 72, a linear actuator screw nut 73, a compact linear actuator 74, a linear actuator screw 75, a linear actuator screw assembly 76, upper arms 77, and lower arms 78. The platen 61 is the component of the compacting mechanism 60 that physically contacts and compacts the waste within the waste receptacle 50. The platen 61 comprises a mechanism chamber 62, a lower plate 63, upper platen blocks 66, lower arm blocks 67, linear guide block bearings 68, and L-shaped connectors 69. The upper linear actuator bracket 70 is a support that is used to hold the compact linear actuator 74. The upper linear actuator bracket 70 is connected and secured to the top wall 7. The linear actuator screw 75 is connected to the compact linear actuator 74. The linear actuator screw assembly 76 is used to secure the screw onto the compact linear actuator 74. The linear actuator screw assembly 76 is then jointly connected and secured onto the upper linear actuator bracket 70. The linear actuator screw 75 protrudes and extends from the compact linear actuator 74 and out the linear actuator screw assembly 76. The compact linear actuator 74 and the linear actuator screw assembly 76 are able to independently rotate with respect to the upper linear actuator bracket 70. The compact linear actuator 74 can be any type of linear actuators including electro-mechanical actuators such as motors or hydraulic actuators such as hydraulic pistons. The upper arms bracket 71 is connected to the top wall 7 aligned with and parallel to the upper linear actuator bracket 70. The upper arms 77 are jointly connected to the upper arms bracket 71 by a first upper end. The middle bracket 72 is connected to the upper arms 77, adjacent to the first upper end in a perpendicular relationship. The middle bracket 72 is able to rotate independently between the upper arms 77. The middle bracket 72 comprises a through hole 721 for the linear actuator screw 75. The linear actuator screw nut 73 is connected to the middle bracket 72 and is aligned with the through hole 721. The linear actuator screw 75 extending from the compact linear actuator 74 and the linear actuator screw assembly 76 is passed through the through hole 721 and threaded through the linear actuator screw nut 73. The threaded screw 75 along with the linear actuator screw nut 73 is used to control the lowering and the raising of the platen 61 of the compacting mechanism 60. The lower arms 78 having first lower ends and second lower ends are connected to the upper arms 77 by the first lower ends to the second upper ends, respectively. The lower arms 78 are then jointly connected to the lower arm blocks 67 of the platen 61 at the second lower ends.

Figure 5:
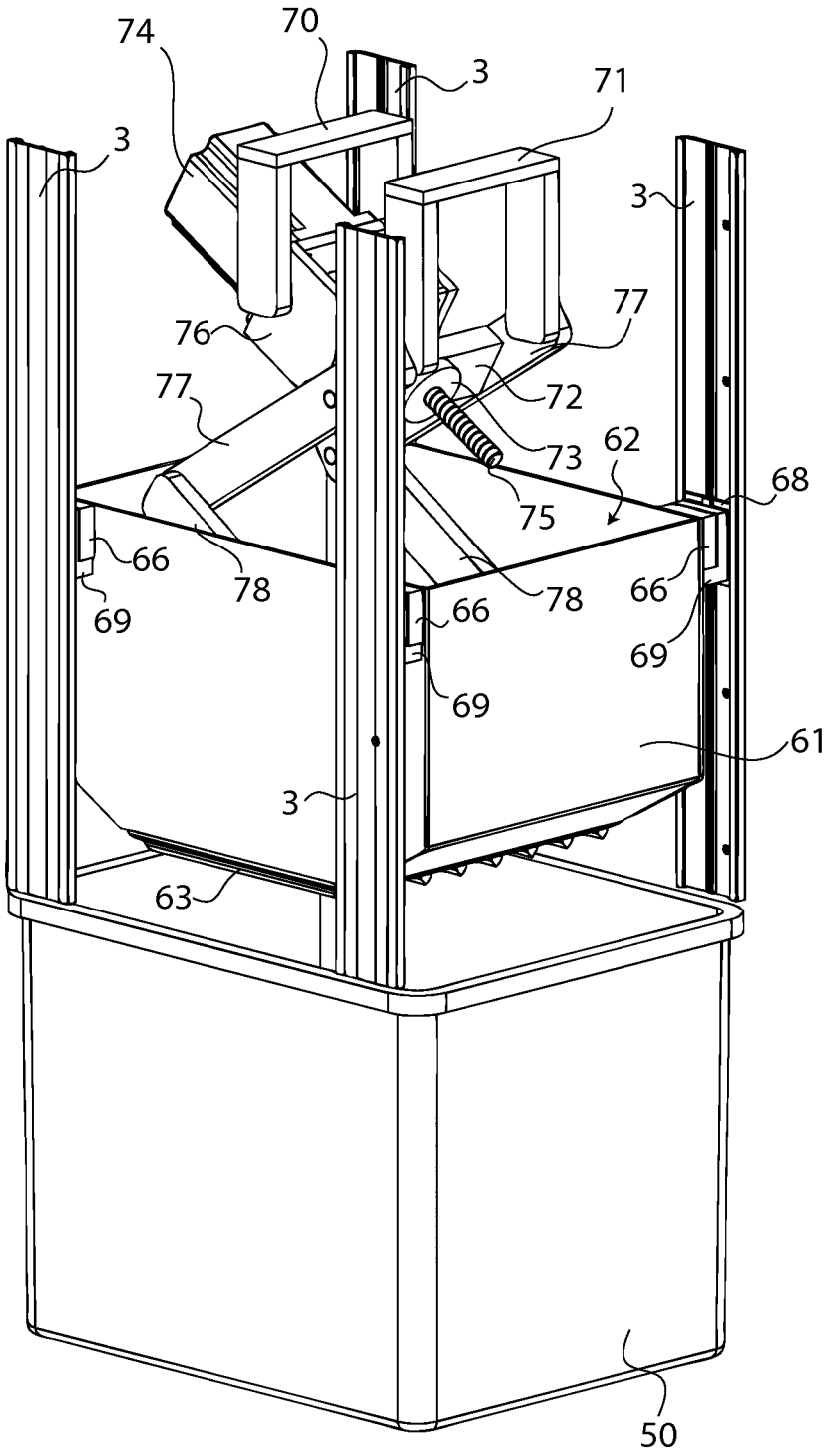
FIG. 5 is a perspective view of the present invention without the compactor enclosure exposing the linear guide rails, the compacting mechanism, and the waste receptacle. The compacting mechanism is in an extended position.
Figure 6:
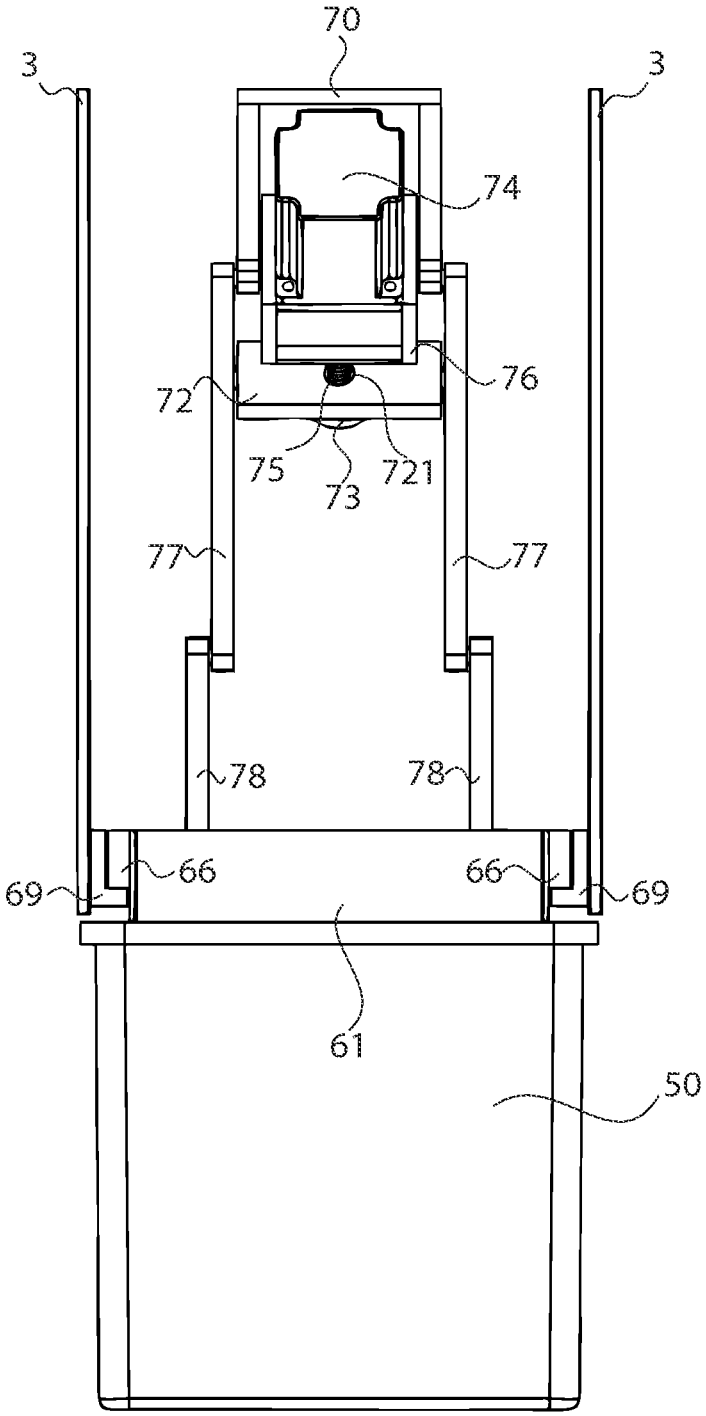
FIG. 6 is a rear elevational view of the present invention without the compactor enclosure exposing the linear guide rails, the compacting mechanism, and the waste receptacle. The compacting mechanism is in an extended position.
Figure 7:
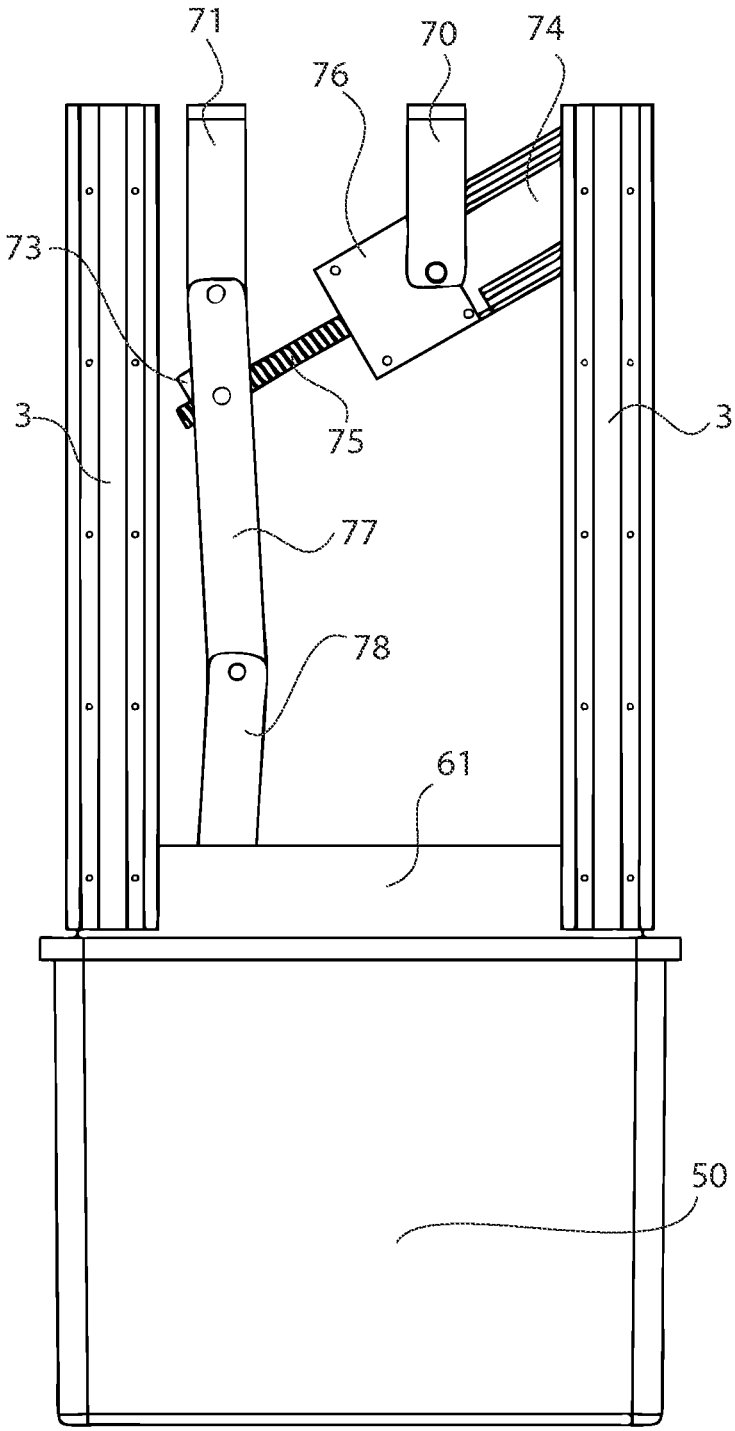
FIG. 7 is a left side elevational view of the present invention without the compactor enclosure exposing the linear guide rails, the compacting mechanism, and the waste receptacle. The compacting mechanism is in an extended position.
Figure 8:
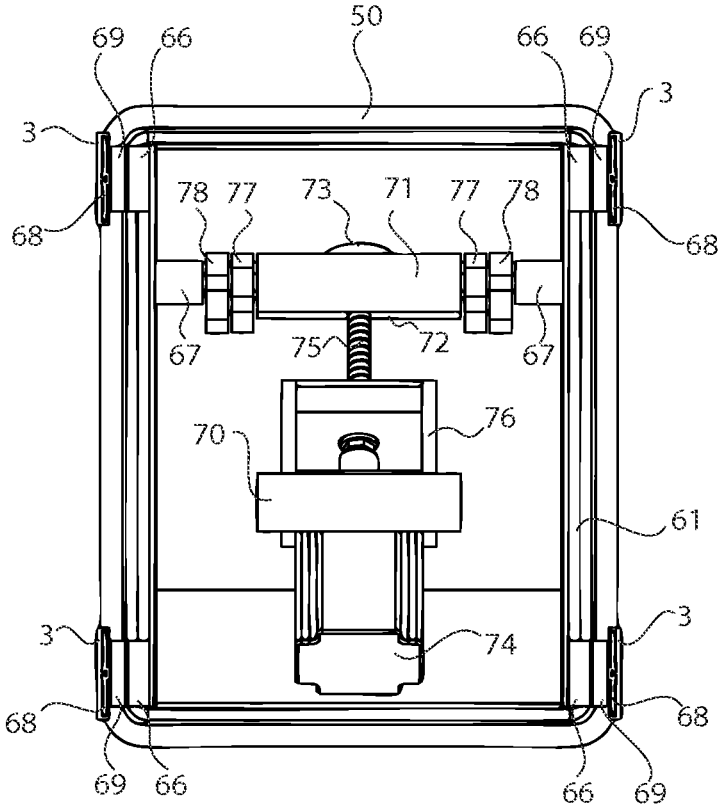
FIG. 8 is a top plan view of the present invention without the compactor enclosure exposing the linear guide rails, the compacting mechanism, and the waste receptacle. The compacting mechanism is in an extended position.
Figure 9:
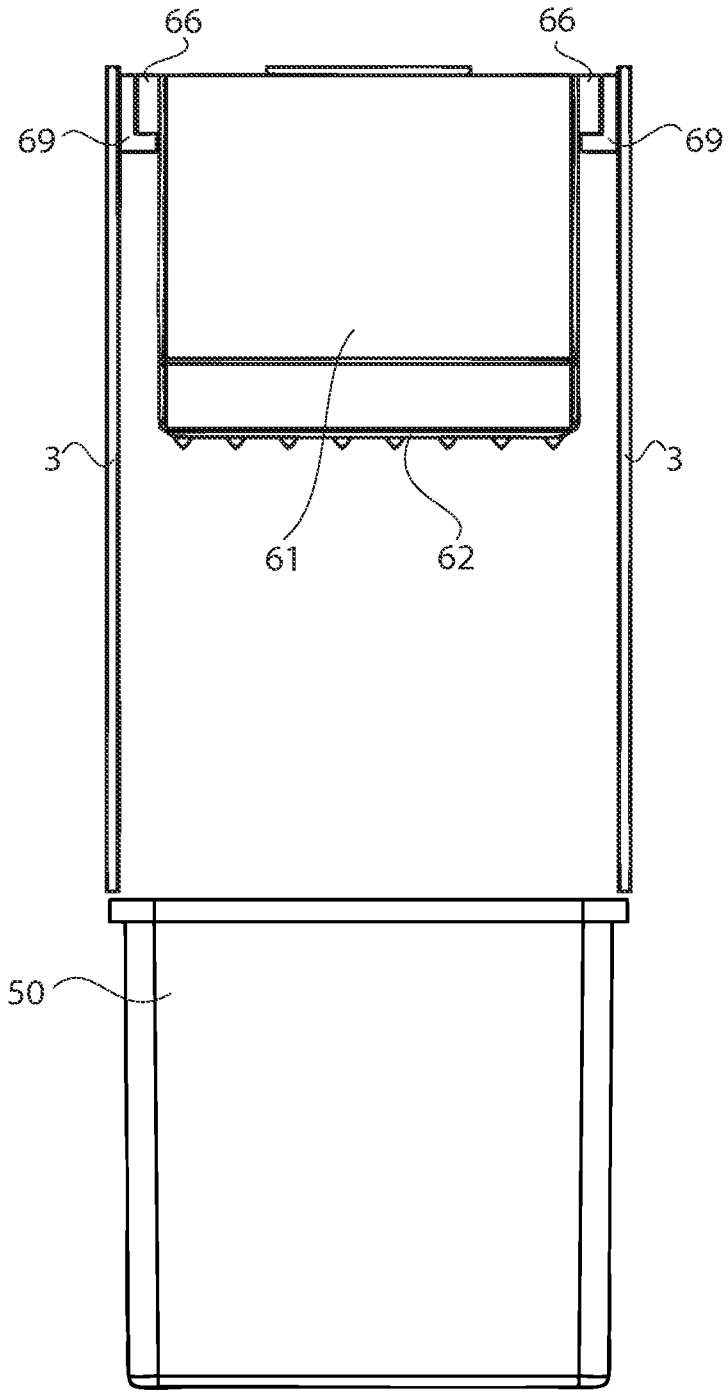
FIG. 9 is a rear elevational view of the present invention without the compactor enclosure exposing the linear guide rails, the compacting mechanism, and the waste receptacle. The compacting mechanism is in a retracted position.
Figure 10:
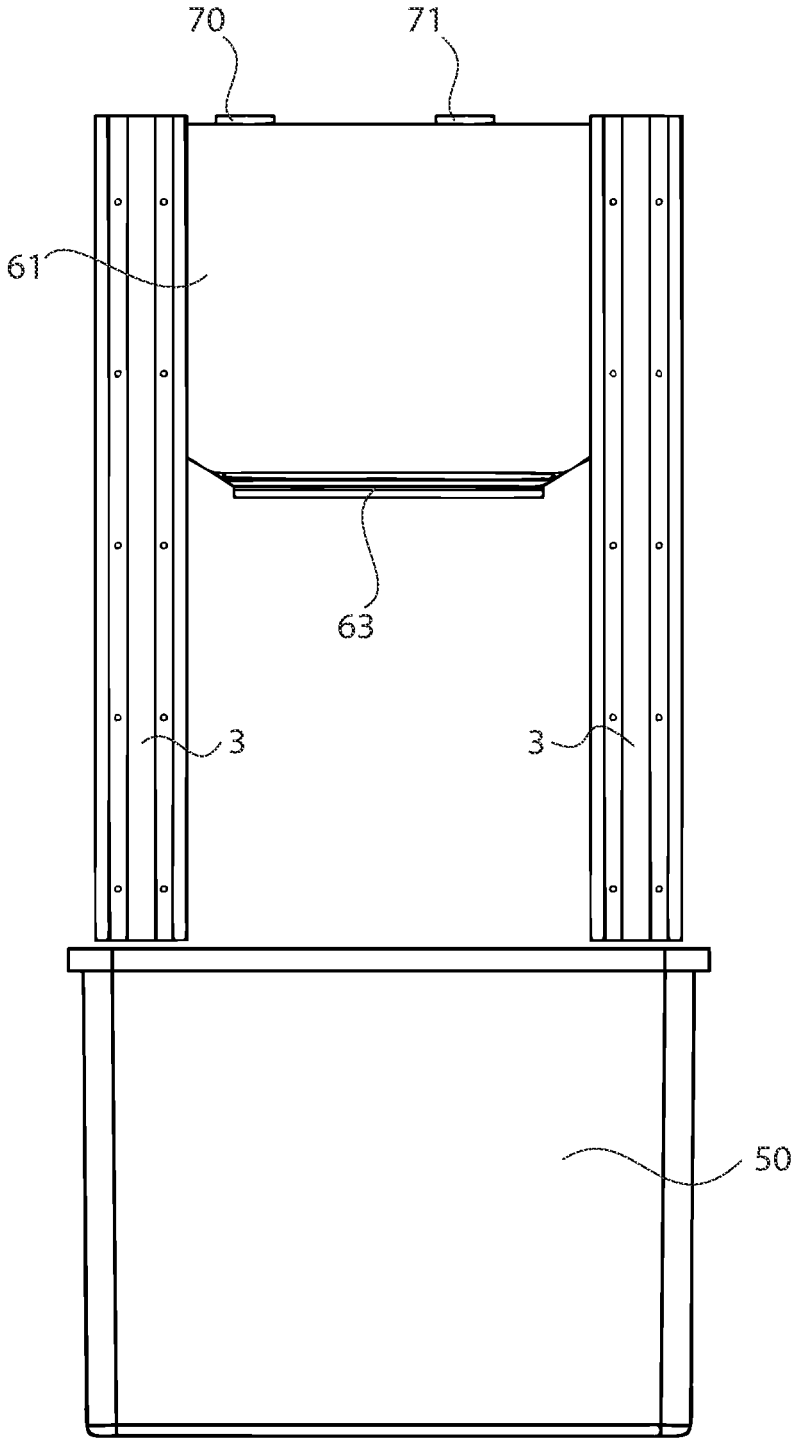
FIG. 10 is a left side elevational view of the present invention without the compactor enclosure exposing the linear guide rails, the compacting mechanism, and the waste receptacle. The compacting mechanism is in a retracted position.
Figure 11:
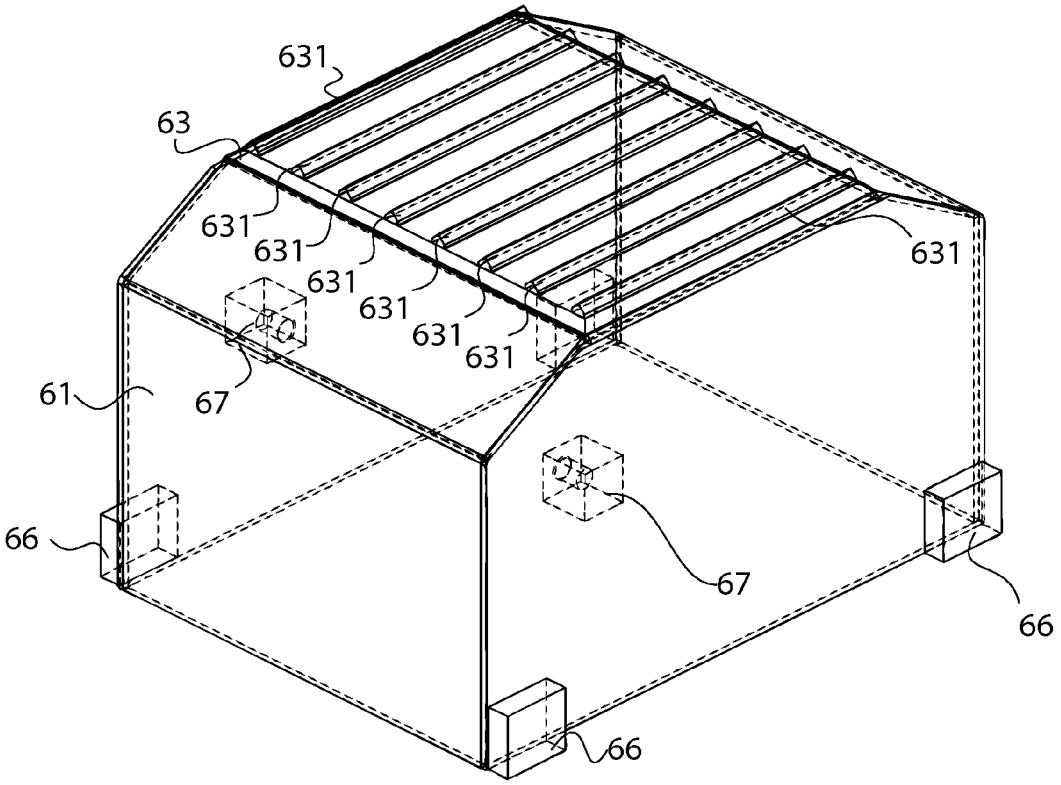
FIG. 11 is a bottom view of the platen.
Figure 12:
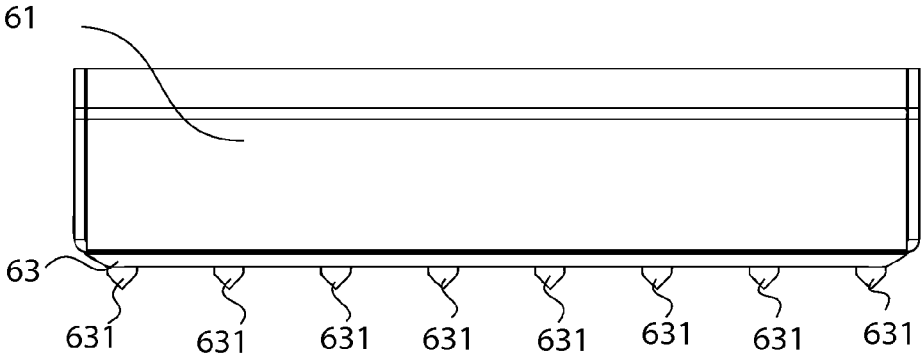
FIG. 12 is a side view of the V-shaped members of the platen.
Figure 13:
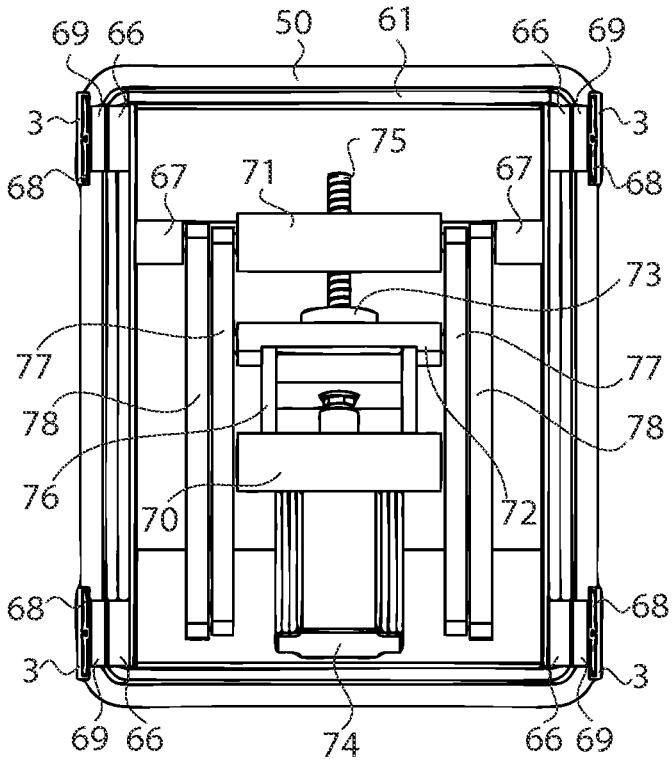
FIG. 13 is a top plan view of the present invention without the compactor enclosure exposing the linear guide rails, the compacting mechanism, and the waste receptacle. The compacting mechanism is in a retracted position.
Figure 14:
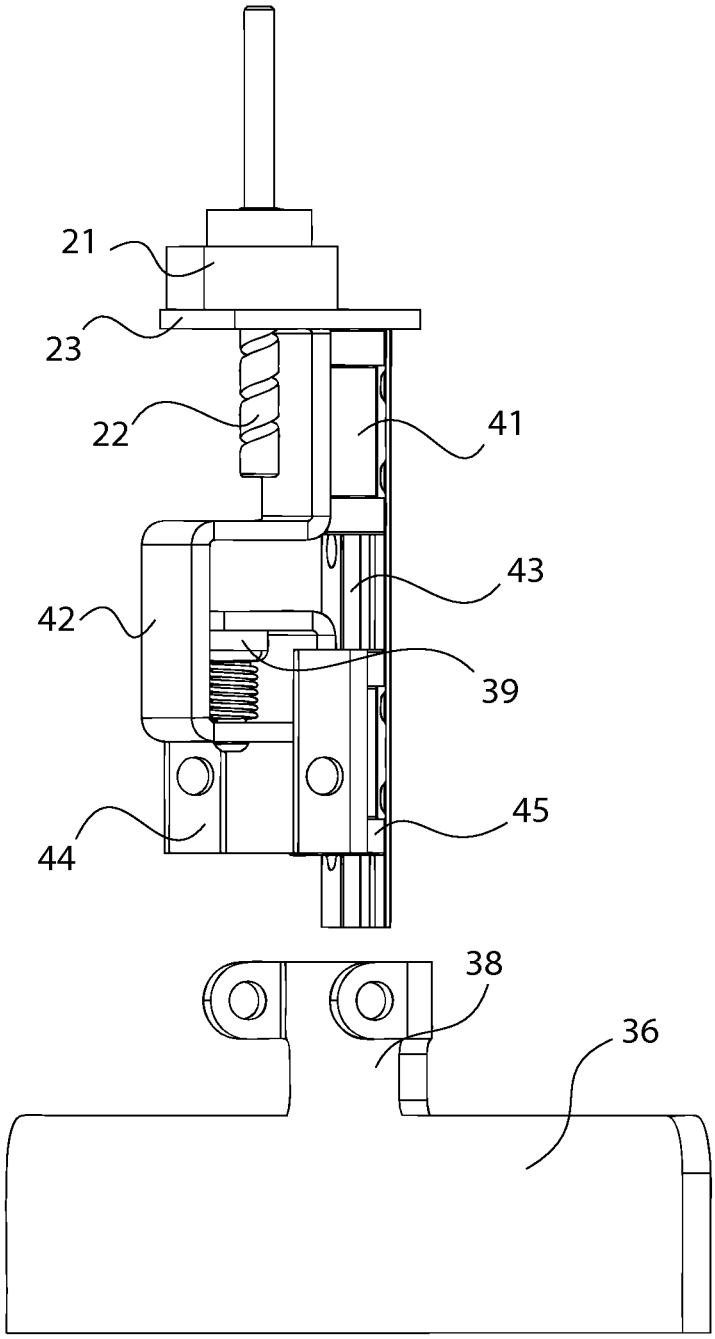
FIG. 14 is a view of the lift gate without the gate connection bracket showing the gate lever.
Figure 15:
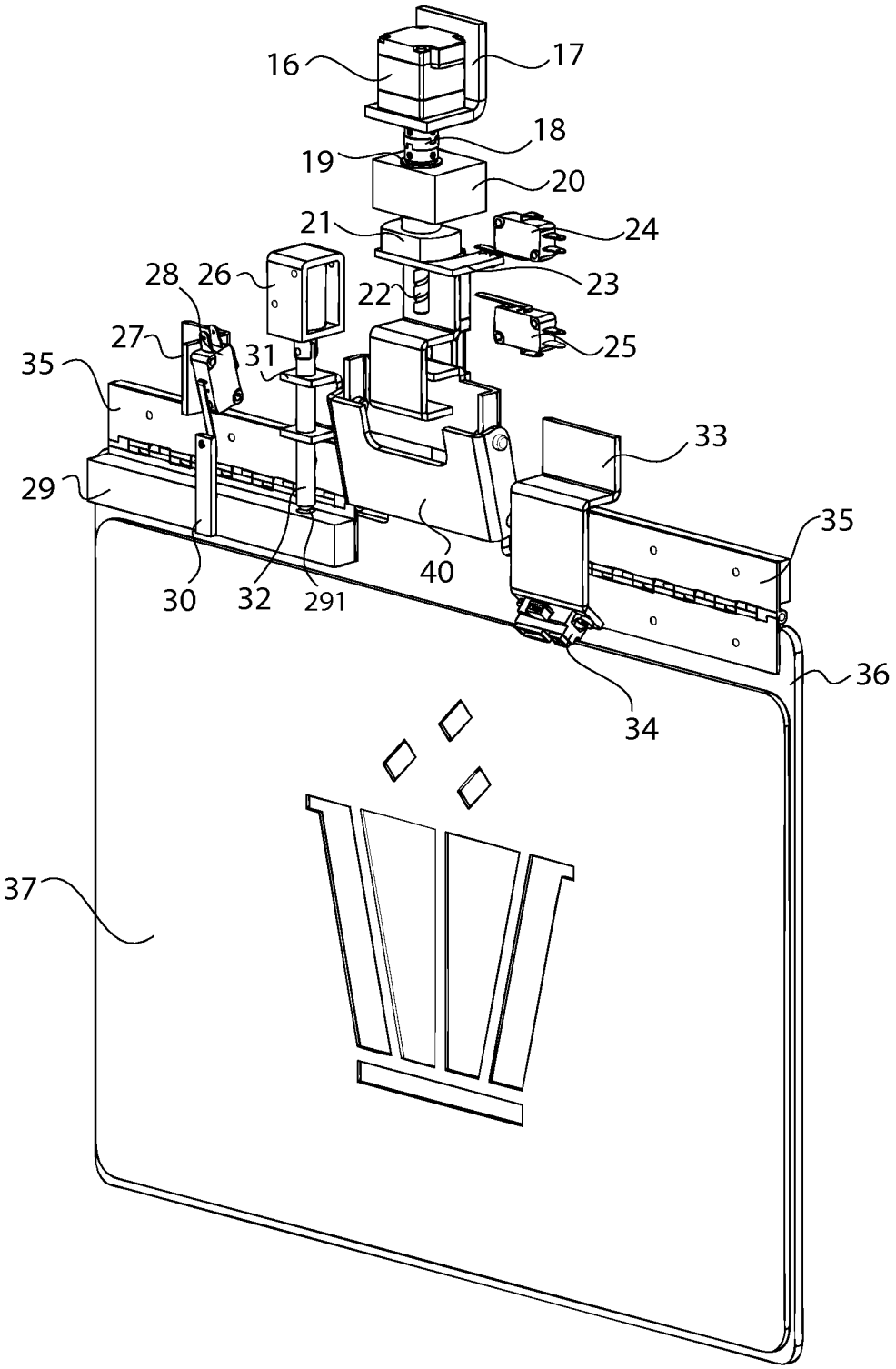
FIG. 15 is a perspective view of the lift gate of the present invention. The diagram shows the mechanisms involved for automating the lifting of the gate.
Figure 16:
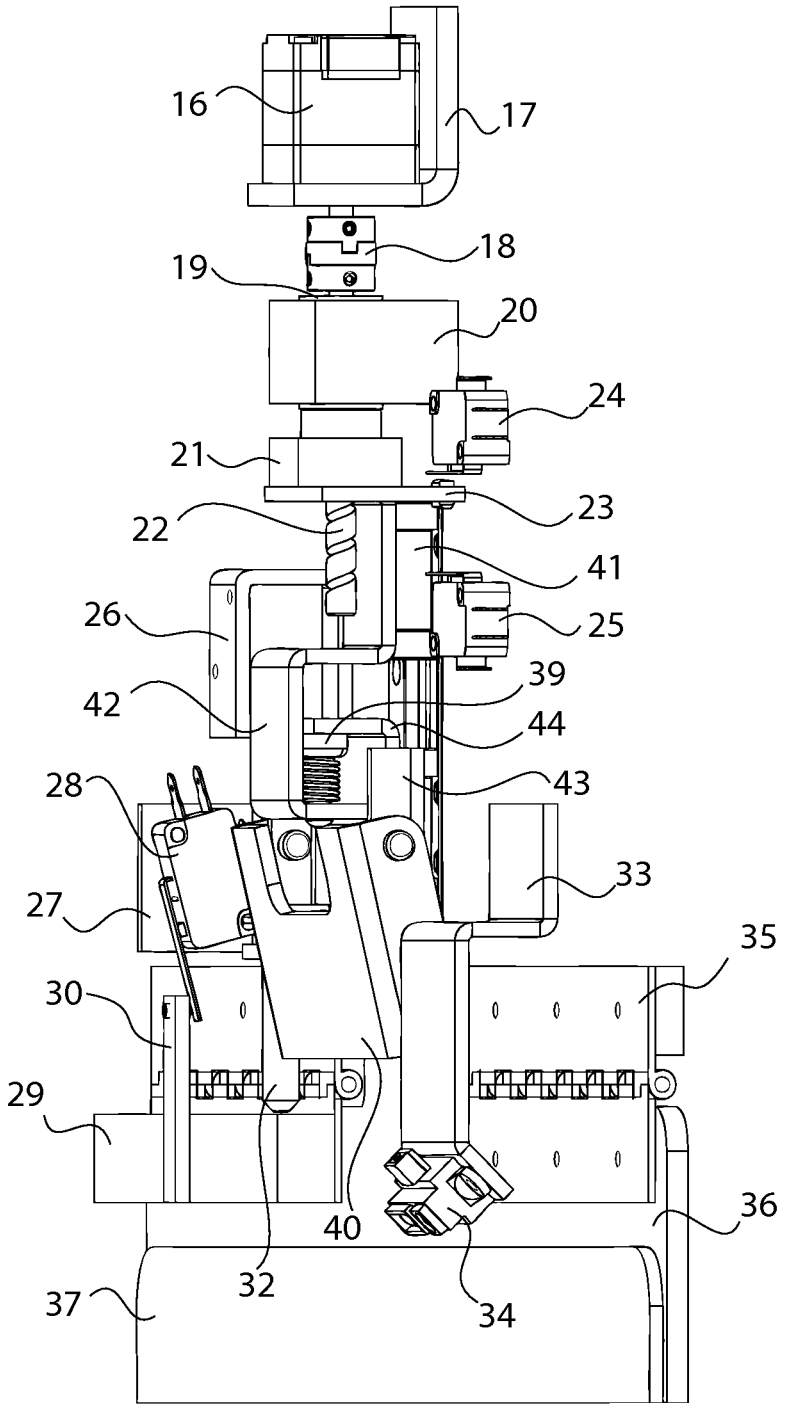
FIG. 16 is a close up view of the mechanisms involved for the automatic lifting of the lift gate.

In reference to FIG. 5, FIG. 11, and FIG. 12, the platen 61 is box shaped with two tapered edges on the bottom face. The mechanism chamber 62 is a recessed space on the platen 61. Though the main purpose of the platen 61 is to compact the wasted collected in the waste receptacle 50 with the mechanism chamber 62, it also serves to enclose the other components of the compacting mechanism 60. Furthermore, because filth and dirt from waste can reduce the operability of the compacting mechanism 60, the mechanism chamber 62 also serves to isolate and protect the compacting mechanism 60 from contamination from the waste being disposed into the waste bin. On the bottom surface of the platen 61 is connected the lower plate 63. The lower plate 63 comprises V-shaped members 631 that are arranged in parallel relationship to each other forming a ribbed pattern. This type of pattern is used to minimize the amount of waste adhering onto the bottom of the platen 61. The lower arm blocks 67 are connected to platen 61 within the mechanism chamber 62. The lower arm blocks 67 are used for connection to the lower arms 78 of the compacting mechanism 60. The upper platen blocks 66 are connected to the upper corners of the platen 61 that are facing the side walls 6. The upper platen blocks 66 are arranged to correspond to the linear guide rails 3. Over the upper platen blocks 66 are connected the L-shaped connectors 69. The L-shaped connectors 69 are used to further support the platen 61. To transition the blocks to connect to the linear guide rails 3, platen linear guide bearings 68 are connected over the L-shaped connectors 69 and arranged in parallel relationship to the linear guide rails 3.

In reference to FIG. 14-23, the front door 10 is not a solid board, but rather comprises a door frame 11, door cover 12, a lift chamber 14, and a lift gate 15. The door frame 11 is shaped to conform to the side walls 6, the top wall 7 and the bottom wall 9 and to cover enclose the waste chamber. The door frame 11 is connected to the door cover 12 to define the lift chamber 14. The door cover 12 comprises a gate window 121. The door frame 11 comprises a gate opening 111. The gate window 121 and the gate opening 111 are aligned. The gate window 121 is an opening on the door cover 12 leading into the waste chamber. Similarly, the gate opening 111 is an opening on the door frame 11 leading into the waste chamber. The lift gate 15 is positioned within the lift chamber 14 in the front door 10. The lift gate 15 comprises a gate linear actuator 16, a gate linear actuator bracket 17, a gate linear actuator coupling 18, gate ball bearings 19, a gate bearing block 20, a gate screw nut 21, a gate screw 22, an upper limit switch 24, an lower limit switch 25, a solenoid latch 26, a gate switch bracket 27, a gate close indicator switch 28, a lock bar 29, a flag 30, a locking pin bracket 31, a lock pin 32, a sensor bracket 33, a proximity sensor 34, a gate hinge 35, a gate door 36, a gate cover 37, a gate lever 38, a gate safety device 39, a gate connection bracket 40, a upper linear guide bearing 41, a upper gate bracket 42, a gate linear guide rail 43, a lower gate bracket 44, and a lower linear guide bearing 45. The lift gate 15 is positioned within the lift chamber 14 so that the gate door 36 is aligned with the gate window 121 and the gate opening 111. This way the gate door 36 is able to be lifted clear of the door frame 11 the door cover 12. The lift gate 15 makes use of latter components to implement an automated lifting system that does not require any user involvement. The gate linear actuator 16 creates driving force for the lifting mechanism and is connected to the door frame 11 within the interior chamber by the gate linear actuator bracket 17. The gate linear actuator 16 similar to the compact linear actuator 74 can be any type of linear actuators including electro-mechanical actuators such as motors or hydraulic actuators such as hydraulic pistons. The gate screw 22 is the driver of the lifting mechanism and is connected to the gate linear actuator 16 by means of a gate linear actuator coupling 18. The gate screw 22 is inserted through the gate ball bearings 19, the gate bearing block 20, and the gate screw nut 21. The gate screw nut 21 having threads will translate the rotational movement of the driving screw into the linear movement needed to open and close the gate door 36. Connected to gate screw nut 21 is a gate positioning flag 23 and is positioned between the upper limit switch 24 and the lower limit switch 25. As the gate screw nut 21 is being moved linearly for opening and closing of the gate door 36, the gate positioning flag 23 will come in contact with the lower limit switch 25 and the upper limit switch 24. The gate position flag is used to activate the upper limit switch 24 and the lower limit switch 25 to correspond to the open gate position or the closed gate position. The upper limit switch 24 is connected to the door frame 11 and positioned above the gate positioning flag 23. The lower limit switch 25 is connected to the door frame 11 and positioned below the gate positioning flag 23. The upper gate bracket 42 is connected to the gate positioning flag 23. The upper gate bracket 42 is connected to the upper linear guide bearing 41. The gate linear rail 43 is connected to the door frame 11 in parallel relationship to the upper gate bracket 42. The upper linear guide bearing 41 being connected to and being adjustable in a linear fashion parallel to the gate linear guide rail 43. The lower linear guide bearing 45 is being connected to and being adjustable in a linear fashion parallel to the gate linear guide rail 43. The lower gate bracket 44 is connected to the lower linear guide bearing 45 in a parallel relationship. The lower gate bracket 44 is connected to the upper gate bracket 42 by the gate safety device 39. The gate connection bracket 40 is then jointly connected to the lower gate bracket 44 and extends over the gate lever 38. The gate lever 38 extends upwardly from the gate door 36 and is jointly connected to the gate connection bracket 40. The gate door 36 is connected to the door frame 11 by the gate hinge 35 and aligned with the gate window 121 and the gate opening 111. When the gate linear actuator 16 spins the gate screw 22 to open the gate door 36, the screw will push the upper gate bracket 42 down. The force applied to the upper gate bracket 42 will transfer down to the gate connection bracket 40 and the gate lever 38. The downward force on the gate lever 38 will force the gate door 36 to open. The transfer of forces will work the reverse way as the gate linear actuator 16 is activated to close the gate door 36.

In reference to FIG. 15-21, the lift gate 15 integrates the gate close indicator switch 28 and the proximity sensor 34 to enable automation for the automation of the opening, closing, and the locking of the gate door 36. The proximity sensor 34 is positioned facing the front side of the front door 10. It is connected to the door frame 11 by means of a sensor bracket 33. The sensor bracket 33 extends and provides the proximity sensor 34 an angled surface for mounting. In the preferred embodiment of the present invention, the proximity sensor 34 is angled down to allow the lifting mechanism only sense the presence of a user that is directly in front of the waste bin. When the proximity sensor 34 senses that there is a user in front of the waste bin, the gate linear actuator 16 will work to open the gate door 36. When the presence disappears from the sensor's detection area, the linear actuator will work to close the gate door 36. After a set number of opening and closings of the gate door 36, the lift gate 15 will automatically lock the gate door 36 shut for compaction of the waste disposed into the waste chamber and waste receptacle 50. To lock the gate door 36, the lift gate 15 comprises the solenoid latch 26 that is connected to the door frame 11 adjacent and parallel to the upper gate bracket 42. To physically inhibit any movement of the gate door 36 the lock pin 32 is used. The lock pin 32 is direct connected to the solenoid latch 26 and is inserted through the locking pin bracket 31. The locking pin bracket 31 is used to stabilize the path of the lock pin 32 and is connected to the door frame 11 below the solenoid latch 26. Connected to the gate door 36 is the lock bar 29. The lock bar 29 is connected to the gate door 36 below the lock pin 32 and adjacent to the gate hinge 35. The lock bar 29 comprises a lock hole 291 in which the lock pin 32 is inserted into when the gate door 36 is locked. Adjacent to the lock pin 32 and above the gate hinge 35 is positioned the gate switch bracket 27 for the connection of the gate close indicator switch 28. The gate close indicator switch 28 ensures that the gate door 36 is fully closed before the mechanism proceeds with the locking process. For the activation of the gate close indicator switch 28, the close flag 30 is connected to the lock bar 29 in a perpendicular relationship and arranged in a linear relation to the gate close indicator switch 28. When the gate door 36 is in a closed position, the close flag 30 will naturally depress the gate close indicator switch 28 indicating that the gate door 36 is clear for locking. Overlapping the gate door 36 is the gate cover 37. The gate cover 37 can be a graphic cover that indicates to users that the bin is for waste.

Figure 17:
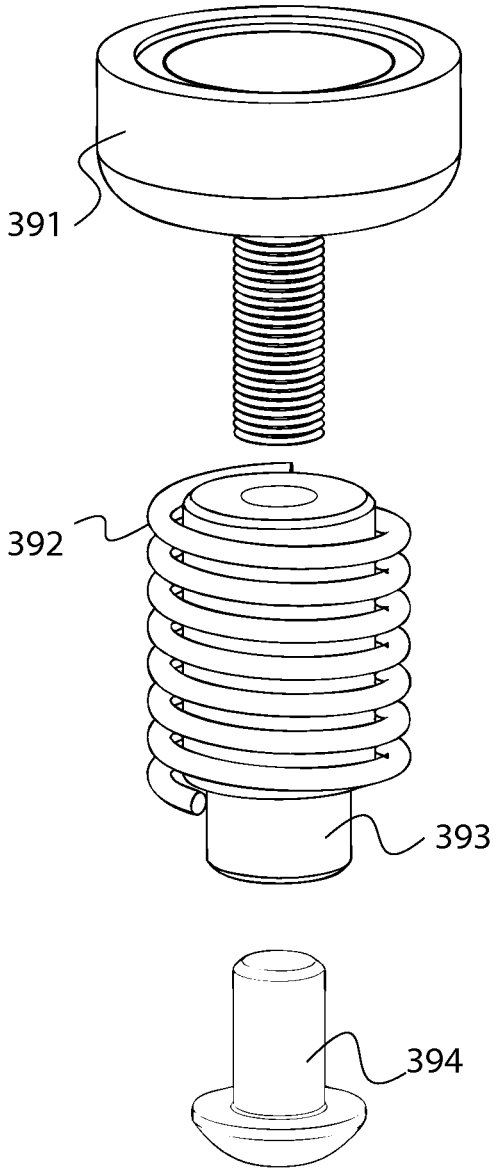
FIG. 17 is a diagram showing the gate safety device of the lift gate.
Figure 18:
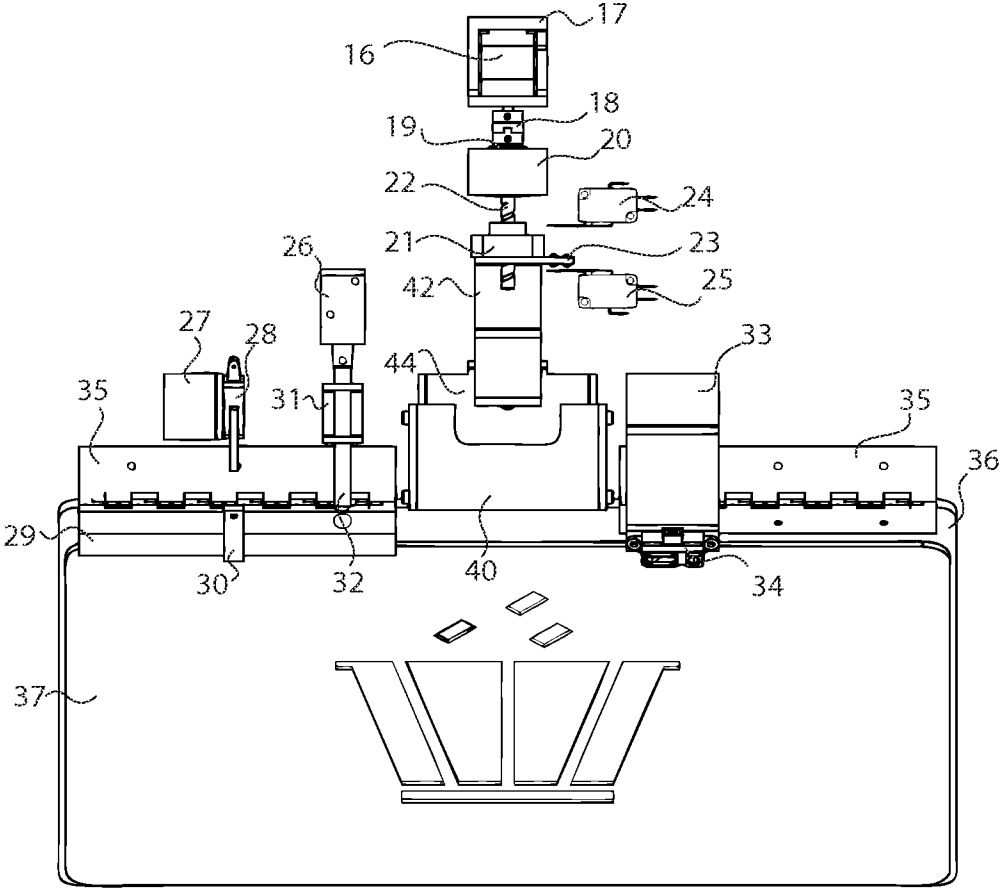
FIG. 18 is a front elevational view of the lift gate with the gate door in an open position.
Figure 19:
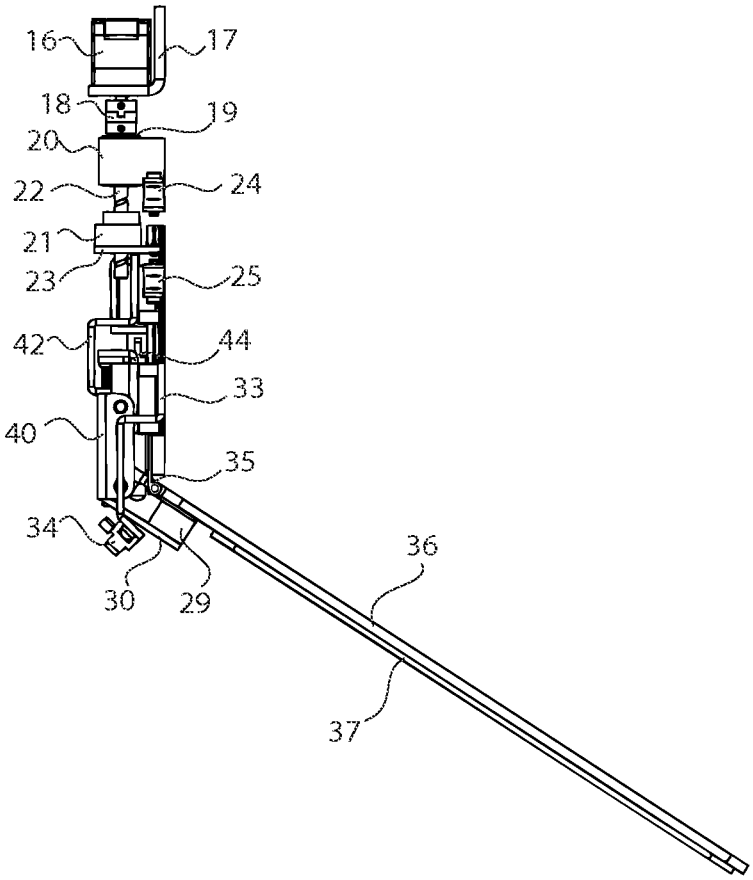
FIG. 19 is a right side elevational view of the lift gate with the gate door in an open position.
Figure 20:
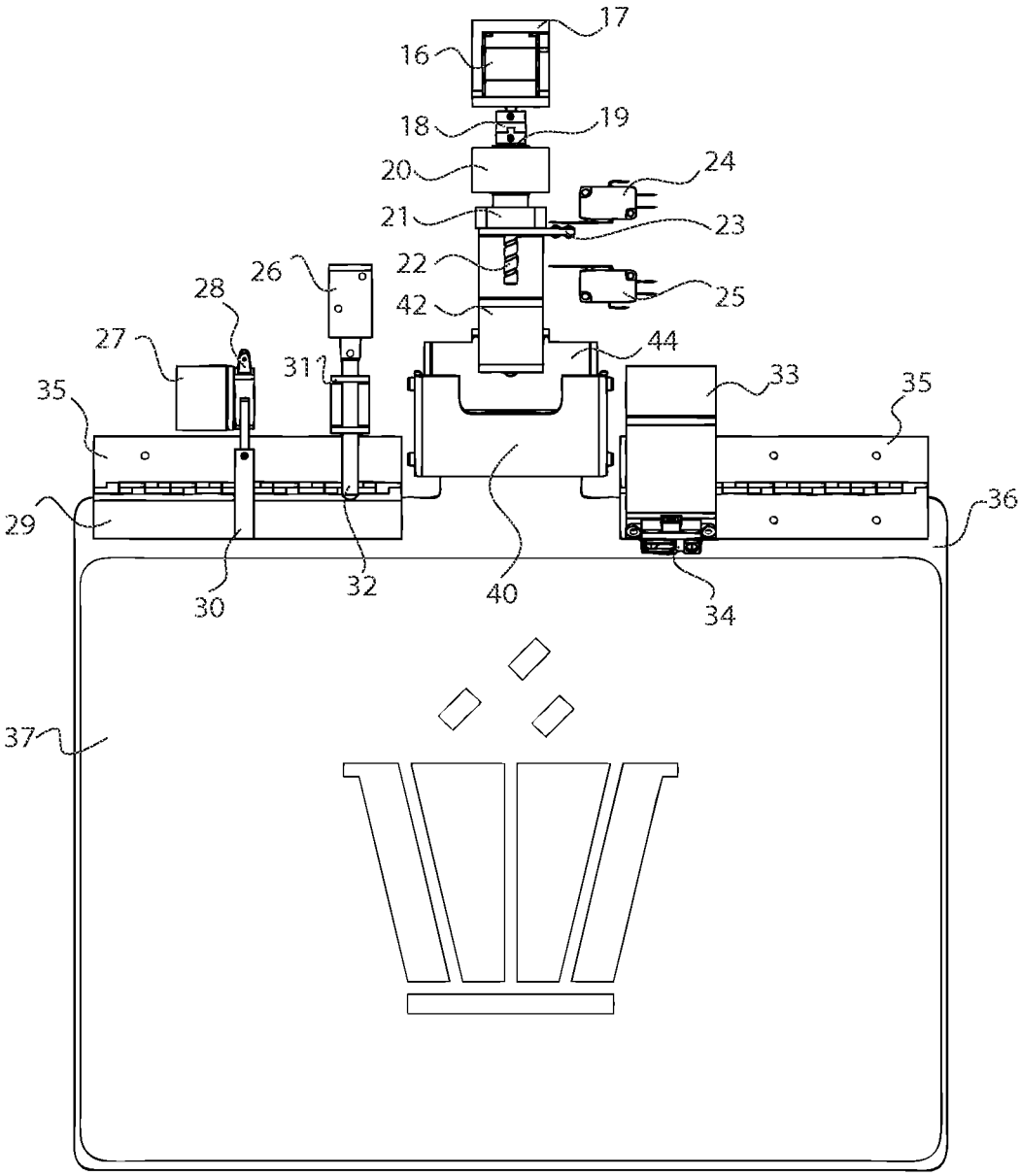
FIG. 20 is a front elevational view of the lift gate with the gate door in a closed position.
Figure 21:
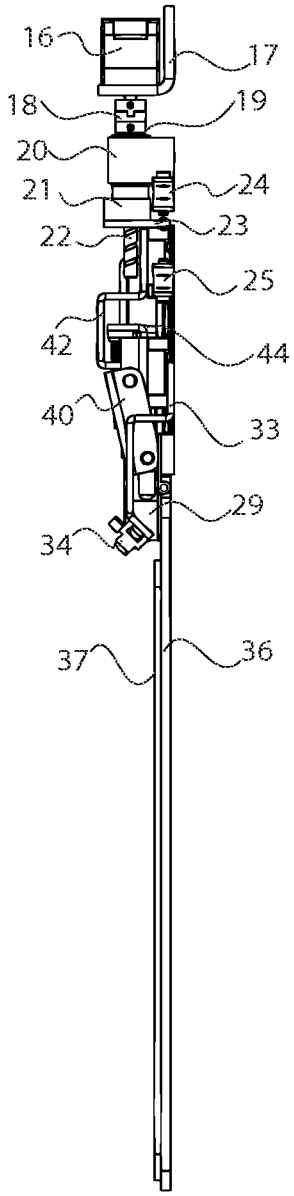
FIG. 21 is a right side elevational view of the lift gate with the gate door in a closed position.
Figure 22:
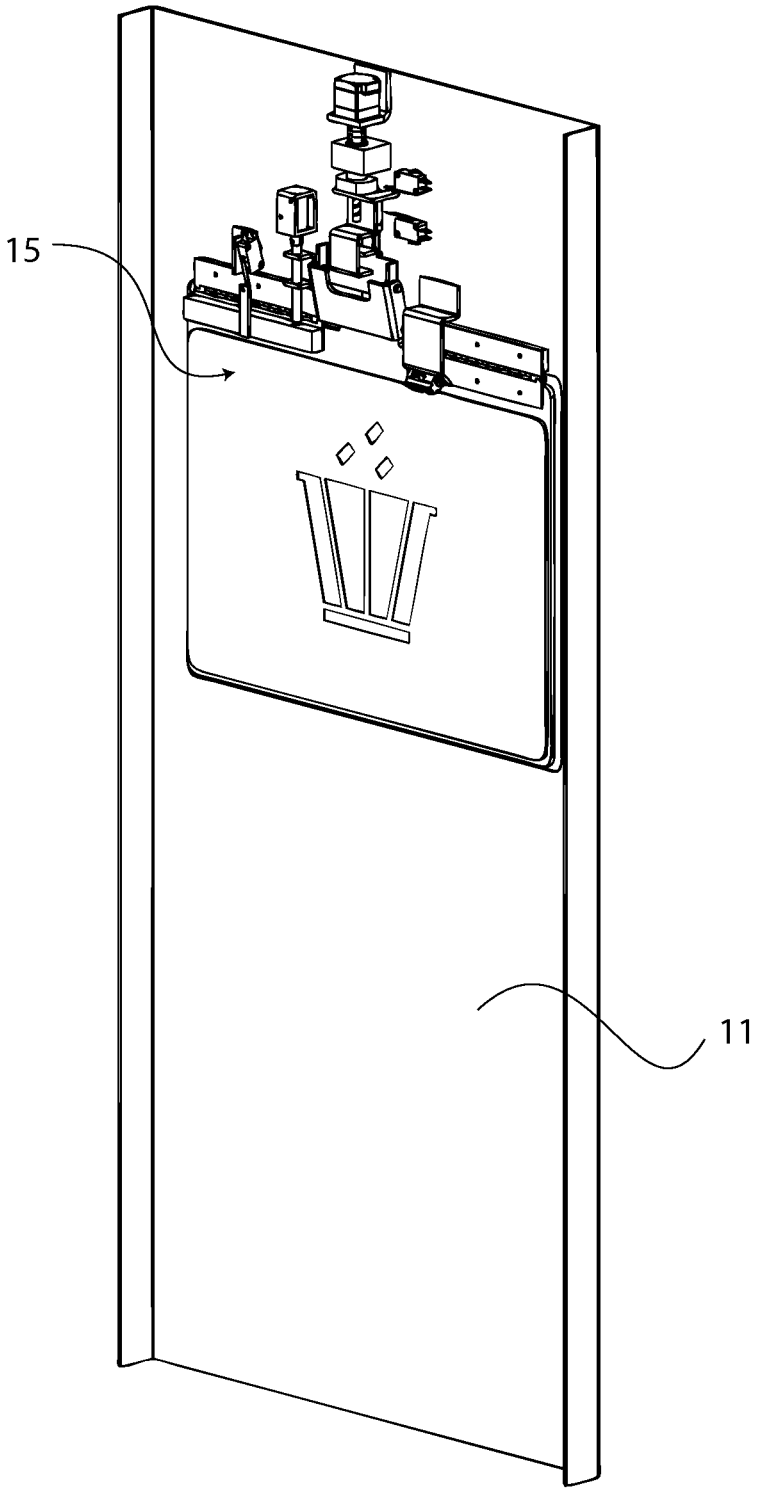
FIG. 22 is a diagram showing the lift gate connected to the door frame within the lift chamber of the front door.
Figure 23:
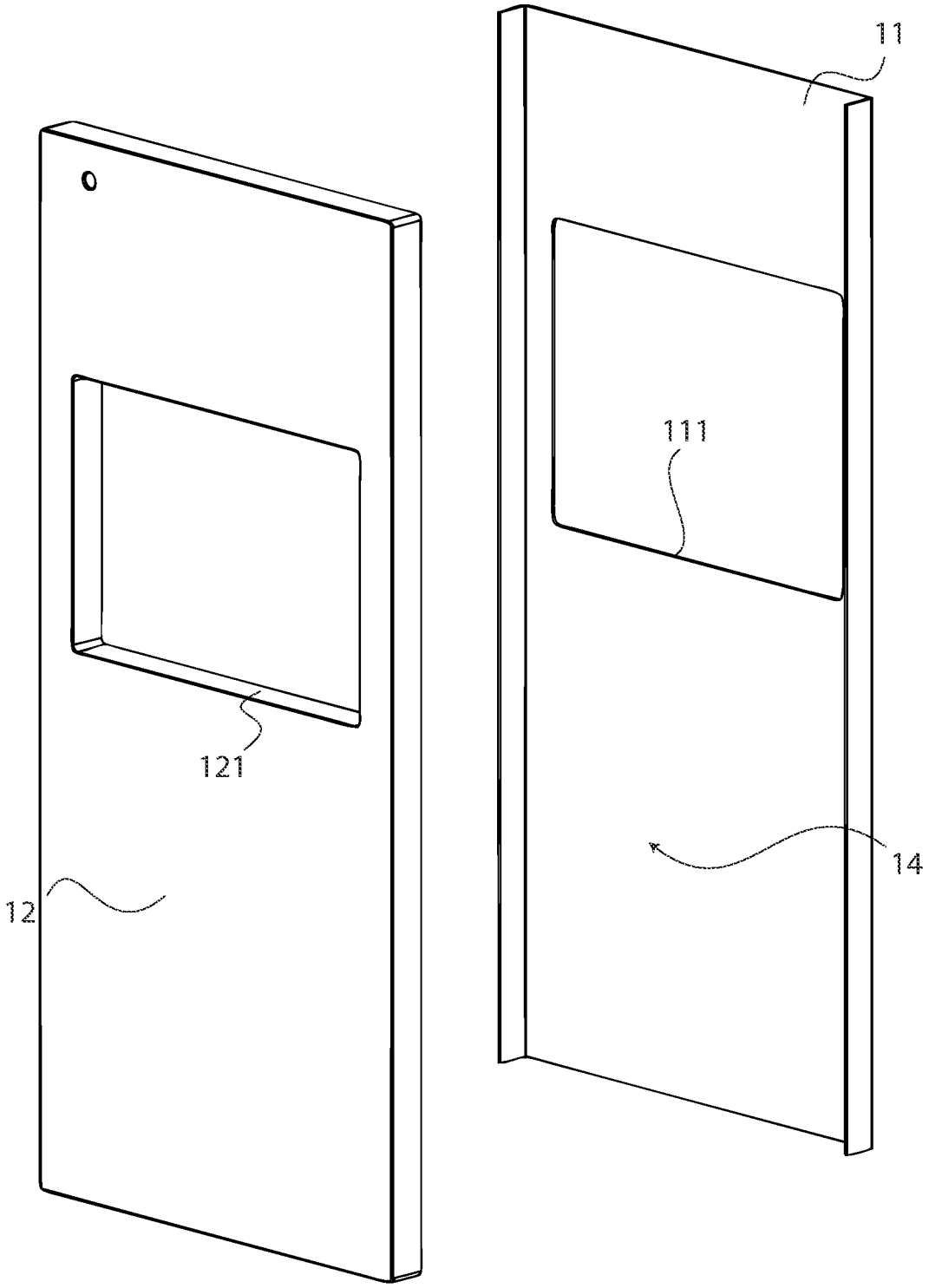
FIG. 23 is an exploded view of the door covers and door frames showing the gate windows.

In reference to FIG. 17, for safety reasons, the lift gate 15 implements a gate safety device 39 between the upper gate bracket 42 and the lower gate bracket 44. In case the lift gate 15 ever closes the gate door 36 onto a user's hands or finger, the gate safety device 39 allows users to still be able to pull their hands out without the risk of injury. The gate safety device 39 comprises a permanent magnet 391, a spring 392, a magnet housing 393, and a magnet screw 394. The spring 392 envelops the magnet housing 393. The permanent magnet 391 is shaped like a bolt with a head and is inserted into the magnet housing 393. The magnet screw 394 is then used to secure the magnet housing 393 to the upper gate bracket 42. When a user's hands are caught by the gate door 36, the spring 392 will provide some room to be pushed open to remove the hand. Because the upper gate bracket 42 is connected directly to the gate screw 22, its position is fixed and will not move. However, with the gate safety device 39, the spring 392 is able to compress to allow the user to open the gate door 36 enough to remove their hands or fingers. In case of an electrical power loss during waste disposal, the permanent magnet 391 enables disengagement of the lift gate 15 by pulling on the gate and causes the gate to come in its vertical orientation thus letting the front door 10 to be able to open. When power is restored and the front door 10 is closed and locked the gate linear actuator 16 comes to its initial position. At that moment the permanent magnet 391 reengages with the lower gate bracket 44 and lift gate 15 normal operation resumes. The lower gate bracket 44 must be made from ferromagnetic material.

Although the invention has been explained in relation to its preferred embodiment, it is to be understood that many other possible modifications and variations can be made without departing from the spirit and scope of the invention as hereinafter claimed.

What is claimed is:

1. A waste compaction and lifting gate mechanism comprises, an external body;

a waste receptacle;

a compacting mechanism;

the external body comprises a tray holder, linear guide rails, leveling feet, a compactor enclosure, and a front door;

the compactor enclosure comprises side walls, a top wall, a rear wall, and a bottom wall;

the rear wall having a top end, a bottom end, a right side, and a left side;

the side walls being connected to the right side and the left side in perpendicular relationship to the rear wall;

the top wall being connected to the side walls and the rear wall on the top end;

the bottom wall being connected to the side walls and the rear wall on the bottom end;

the top wall, the bottom wall, the side walls, and the rear wall defining a waste chamber;

the front door being jointly attached to the side walls;

the tray holder overlapping the top wall;

the compacting mechanism comprises a platen, an upper linear actuator bracket, an upper arms bracket, a middle bar, a linear actuator screw nut, a compact linear actuator, a linear actuator screw, a linear actuator screw assembly, upper arms, and lower arms; and the platen comprises a mechanism chamber, a lower plate, upper platen blocks, lower arm blocks, platen linear guide bearings, and L-shaped connectors.

2. The waste compaction and lifting gate mechanism as claimed in claim 1 comprises, the upper linear actuator bracket being connected to the top wall;

the compact linear actuator being secured with the linear actuator screw by the linear actuator screw assembly;

the linear actuator screw protruding from the linear actuator screw assembly;

the linear actuator screw being independently rotatable from the compact linear actuator and the linear actuator screw assembly;

the linear actuator screw assembly being jointly attached to the upper linear actuator bracket the upper arm bracket being connected to the top wall aligned and in parallel relationship to the upper linear actuator bracket;

the upper arms having first upper ends and second upper ends;

the upper arm bracket being jointly connected to the first upper ends;

the middle bracket being jointly connected to the upper arms adjacent to the first upper ends in a perpendicular relationship;

the middle bracket having a through hole;

the linear actuator screw nut being connected to the middle bracket and being concentrically aligned to the through hole;

the linear actuator screw being inserted through the through hole and the linear actuator screw nut;

the lower arms having a first lower ends and a second lower ends;

the lower arms being jointly connected to the upper arms by the first lower ends and the second upper ends, respectively;

the lower arms being jointly connected to the lower arm blocks at the second lower ends; and the compact linear actuator being activated to push or pull on the middle bracket to lift or lower the platen by means of the upper arms and the lower arms along the linear guide rails.

3. The waste compaction and lifting gate mechanism as claimed in claim 1 comprises, the platen being box shaped having two tapered edges and upper corners;

the mechanism chamber being a recessed space on the platen;

the lower plate being downwardly positioned on the platen;

the lower arm block being connected to the platen within the mechanism chamber;

the upper platen block being connected to the upper corners of the platen;

the L-shaped connectors being connected to the upper platen blocks;

the linear guide block being connected to the L-shaped connectors and positioned parallel with the linear guide rails; and the lower plate having V-shaped members arranged parallel relationship.

4. The waste compaction and lifting gate mechanism as claimed in claim 1 comprises, the waste receptacle being positioned in the waste chamber;

the side walls having a front side and a rear side;

the linear guide rails positioned on the side walls on the front side adjacent to the front door and on the rear side adjacent to the rear wall in parallel relationship; and the leveling feet connected to the bottom wall.

5. The waste compaction and lifting gate mechanism as claimed in claim 1 comprises, the front door comprises a door frame, door covers, a lift chamber, and a lift gate;

the door frame comprises a gate opening;

the door cover comprises a gate window;

the door frame connecting to the door covers defining the lift chamber;

the gate opening being an opening positioned on the door frame and being aligned with to the gate window;

the gate window being an opening positioned on the door cover; and the lift gate being positioned and connected to the front door within the lift chamber.

6. The waste compaction and lifting gate mechanism as claimed in claim 1 comprises, the lift gate comprises a gate linear actuator, a gate linear actuator bracket, a gate linear actuator coupling, gate ball bearings, a gate bearing block, a gate screw nut, a gate screw, an upper limit switch, an lower limit switch, a solenoid latch, a gate switch bracket, a gate close indicator switch, a lock bar, a flag, a locking pin bracket, a locking pin, a sensor bracket, a proximity sensor, a gate hinge, a gate door, a gate cover, a gate lever, a gate safety device, a gate connection bracket, a upper linear guide bearing, a upper gate bracket, a gate linear guide rail, a lower gate bracket, and a lower linear guide bearing;

the gate linear actuator being connected to the gate linear actuator bracket;

the gate screw being connected to the gate linear actuator by means of a gate linear actuator coupling;

the gate screw being inserted through the gate ball bearings, the gate bearing block, and the gate screw nut;

the gate positioning flag connected to the gate screw nut and positioned between the upper limit switch and the lower limit switch;

the upper limit switch being connected to the door frame;

the lower limit switch being connected to the door frame downwardly from the upper limit switch;

the upper gate bracket being connected to the gate positioning flag;

the upper linear guide bearing being connected to the upper bracket in parallel relationship;

the lower linear guide bearing being connected to the door frame in parallel relationship to the upper gate bracket;

the lower gate bracket being connected to the lower linear guide bearing;

the upper linear guide bearing and the lower linear guide bearing being latched to the gate linear guide;

the lower gate bracket being connected to the upper gate bracket by the gate safety device;

the gate connection bracket being jointly connected to the lower gate bracket;

the gate lever upwardly extending from the gate door;

the gate lever being jointly connected to the gate connection bracket;

the solenoid latch being connected to the door frame adjacent to and in parallel relationship to the upper gate bracket;

the locking pin bracket being connected to the door frame;

the locking pin being connected to the solenoid latch and inserted through the locking pin bracket;

the gate switch bracket being connected to the door frame adjacent to and in parallel relationship to the locking pin;

the gate close indicator switch being connected to the gate switch bracket;

the gate door being connected to the door frame by the gate hinge;

the lock bar connected to the gate door downwardly from the locking pin and the gate hinge;

the lock bar arranged in parallel relationship to the gate hinge;

the lock bar comprise of a lock hole;

the close flag being connected in perpendicular relationship to the lock bar and linear relationship to the gate close indicator switch;

the sensor bracket being connected to the door frame and arranged adjacent to the gate connection bracket;

the proximity sensor being connected to the sensor bracket; and the gate cover overlapping the gate door.

7. The waste compaction and lifting gate mechanism as claimed in claim 6 comprises, the gate linear actuator being activated to push or pull on the gate lever to lift or lower the gate door through the upper gate bracket, lower gate bracket, and gate connection bracket;

the gate safety device comprises a permanent magnet, a spring, a magnet housing, and a magnet screw;

the spring being enveloped about the magnet housing;

the permanent magnet being inserted into the magnet housing; and the magnet screw securing the permanent magnet to the magnet housing.

8. A waste compaction and lifting gate mechanism comprises, an external body;

a waste receptacle;

a compacting mechanism;

the external body comprises a tray holder, linear guide rails, leveling feet, a compactor enclosure, and a front door;

the compactor enclosure comprises side walls, a top wall, a rear wall, and a bottom wall;

the rear wall having a top end, a bottom end, a right side, and a left side;

the side walls being connected to the right side and the left side in perpendicular relationship to the rear wall;

the top wall being connected to the side walls and the rear wall on the top end;

the bottom wall being connected to the side walls and the rear wall on the bottom end;

the top wall, the bottom wall, the side walls, and the rear wall defining a waste chamber;

the front door being jointly attached to the side walls;

the tray holder overlapping the top wall;

the front door comprises a door frame, door covers, a lift chamber, and a lift gate;

the door frame comprises a gate opening;

the door cover comprises a gate window;

the door frame connecting to the door covers defining the lift chamber;

the gate opening being an opening positioned on the door frame and being aligned with to the gate window;

the gate window being an opening positioned on the door cover;

the lift gate being positioned and connected to the front door within the lift chamber;

the lift gate comprises a gate linear actuator, a gate linear actuator bracket, a gate linear actuator coupling, gate ball bearings, a gate bearing block, a gate screw nut, a gate screw, an upper limit switch, an lower limit switch, a solenoid latch, a gate switch bracket, a gate close indicator switch, a lock bar, a flag, a locking pin bracket, a locking pin, a sensor bracket, a proximity sensor, a gate hinge, a gate door, a gate cover, a gate lever, a gate safety device, a gate connection bracket, a upper linear guide bearing, a upper gate bracket, a gate linear guide rail, a lower gate bracket, and a lower linear guide bearing;

the gate linear actuator being connected to the gate linear actuator bracket;

the gate screw being connected to the gate linear actuator by means of a gate linear actuator coupling;

the gate screw being inserted through the gate ball bearings, the gate bearing block, and the gate screw nut;

the gate positioning flag connected to the gate screw nut and positioned between the upper limit switch and the lower limit switch;

the upper limit switch being connected to the door frame; and the lower limit switch being connected to the door frame downwardly from the upper limit switch.

9. The waste compaction and lifting gate mechanism as claimed in claim 8 comprises, the compacting mechanism comprises a platen, a upper linear actuator bracket, a upper arms bracket, a middle bar, a linear actuator screw nut, a compact linear actuator, a linear actuator screw, a linear actuator screw assembly, upper arms, and lower arms; and the platen comprises a mechanism chamber, a lower plate, upper platen blocks, lower arm blocks, platen linear guide bearings, and L-shaped connectors.

10. The waste compaction and lifting gate mechanism as claimed in claim 9 comprises, the upper linear actuator bracket being connected to the top wall;

the compact linear actuator being secured with the linear actuator screw by the linear actuator screw assembly;

the linear actuator screw protruding from the linear actuator screw assembly;

the linear actuator screw being independently rotatable from the compact linear actuator and the linear actuator screw assembly;

the linear actuator screw assembly being jointly attached to the upper linear actuator bracket;

the upper arm bracket being connected to the top wall aligned and in parallel relationship to the upper linear actuator bracket;

the upper arms having first upper ends and second upper ends;

the upper arm bracket being jointly connected to the first upper ends;

the middle bracket being jointly connected to the upper arms adjacent to the first upper ends in a perpendicular relationship;

the middle bracket having a through hole;

the linear actuator screw nut being connected to the middle bracket and being concentrically aligned to the through hole;

the linear actuator screw being inserted through the through hole and the linear actuator screw nut;

the lower arms having a first lower ends and a second lower ends;

the lower arms being jointly connected to the upper arms by the first lower ends and the second upper ends, respectively;

the lower arms being jointly connected to the lower arm blocks at the second lower ends; and the compact linear actuator being activated to push or pull on the middle bracket to lift or lower the platen by means of the upper arms and the lower arms along the linear guide rails.

11. The waste compaction and lifting gate mechanism as claimed in claim 9 comprises, the platen being box shaped having two tapered edges and upper corners;

the mechanism chamber being a recessed space on the platen;

the lower plate being downwardly positioned on the platen;

the lower arm block being connected to the platen within the mechanism chamber;

the upper platen block being connected to the upper corners of the platen;

the L-shaped connectors being connected to the upper platen blocks;

the linear guide block being connected to the L-shaped connectors and positioned parallel with the linear guide rails; and the lower plate having V-shaped members arranged parallel relationship.

12. The waste compaction and lifting gate mechanism as claimed in claim 8 comprises, the waste receptacle being positioned in the waste chamber;

the side walls having a front side and a rear side;

the linear guide rails positioned on the side walls on the front side adjacent to the front door and on the rear side adjacent to the rear wall in parallel relationship; and the leveling feet connected to the bottom wall.

13. The waste compaction and lifting gate mechanism as claimed in claim 8 comprises, the upper gate bracket being connected to the gate positioning flag;

the upper linear guide bearing being connected to the upper bracket in parallel relationship;

the lower linear guide bearing being connected to the door frame in parallel relationship to the upper gate bracket;

the lower gate bracket being connected to the lower linear guide bearing;

the upper linear guide bearing and the lower linear guide bearing being latched to the gate linear guide;

the lower gate bracket being connected to the upper gate bracket by the gate safety device;

the gate connection bracket being jointly connected to the lower gate bracket;

the gate lever upwardly extending from the gate door;

the gate lever being jointly connected to the gate connection bracket;

the solenoid latch being connected to the door frame adjacent to and in parallel relationship to the upper gate bracket;

the locking pin bracket being connected to the door frame;

the locking pin being connected to the solenoid latch and inserted through the locking pin bracket;

the gate switch bracket being connected to the door frame adjacent to and in parallel relationship to the locking pin;

the gate close indicator switch being connected to the gate switch bracket;

the gate door being connected to the door frame by the gate hinge;

the lock bar connected to the gate door downwardly from the locking pin and the gate hinge;

the lock bar arranged in parallel relationship to the gate hinge;

the lock bar comprise of a lock hole;

the close flag being connected in perpendicular relationship to the lock bar and linear relationship to the gate close indicator switch;

the sensor bracket being connected to the door frame and arranged adjacent to the gate connection bracket;

the proximity sensor being connected to the sensor bracket; and the gate cover overlapping the gate door.

14. The waste compaction and lifting gate mechanism as claimed in claim 13 comprises, the gate linear actuator being activated to push or pull on the gate lever to lift or lower the gate door through the upper gate bracket, lower gate bracket, and gate connection bracket;

the gate safety device comprises a permanent magnet, a spring, a magnet housing, and a magnet screw;

the spring being enveloped about the magnet housing;

the permanent magnet being inserted into the magnet housing; and the magnet screw securing the permanent magnet to the magnet housing.

15. A waste compaction and lifting gate mechanism comprises, an external body;

a waste receptacle;

a compacting mechanism;

the external body comprises a tray holder, linear guide rails, leveling feet, a compactor enclosure, and a front door;

the compactor enclosure comprises side walls, a top wall, a rear wall, and a bottom wall;

the rear wall having a top end, a bottom end, a right side, and a left side;

the side walls being connected to the right side and the left side in perpendicular relationship to the rear wall;

the top wall being connected to the side walls and the rear wall on the top end;

the bottom wall being connected to the side walls and the rear wall on the bottom end;

the top wall, the bottom wall, the side walls, and the rear wall defining a waste chamber;

the front door being jointly attached to the side walls;

the tray holder overlapping the top wall;

the front door comprises a door frame, door covers, a lift chamber, and a lift gate;

the door frame comprises a gate opening;

the door cover comprises a gate window;

the door frame connecting to the door covers defining the lift chamber;

the gate opening being an opening positioned on the door frame and being aligned with to the gate window;

the gate window being an opening positioned on the door cover;

the lift gate being positioned and connected to the front door within the lift chamber;

the lift gate comprises a gate linear actuator, a gate linear actuator bracket, a gate linear actuator coupling, gate ball bearings, a gate bearing block, a gate screw nut, a gate screw, an upper limit switch, an lower limit switch, a solenoid latch, a gate switch bracket, a gate close indicator switch, a lock bar, a flag, a locking pin bracket, a locking pin, a sensor bracket, a proximity sensor, a gate hinge, a gate door, a gate cover, a gate lever, a gate safety device, a gate connection bracket, a upper linear guide bearing, a upper gate bracket, a gate linear guide rail, a lower gate bracket, and a lower linear guide bearing;

the gate linear actuator being connected to the gate linear actuator bracket;

the gate screw being connected to the gate linear actuator by means of a gate linear actuator coupling;

the gate screw being inserted through the gate ball bearings, the gate bearing block, and the gate screw nut;

the gate positioning flag connected to the gate screw nut and positioned between the upper limit switch and the lower limit switch;

the upper limit switch being connected to the door frame;

the lower limit switch being connected to the door frame downwardly from the upper limit switch;

the compacting mechanism comprises a platen, a upper linear actuator bracket, a upper arms bracket, a middle bar, a linear actuator screw nut, a compact linear actuator, a linear actuator screw, a linear actuator screw assembly, upper arms, and lower arms;

the platen comprises a mechanism chamber, a lower plate, upper platen blocks, lower arm blocks, platen linear guide bearings, and L-shaped connectors;

the upper linear actuator bracket being connected to the top wall;

the compact linear actuator being secured with the linear actuator screw by the linear actuator screw assembly;

the linear actuator screw protruding from the linear actuator screw assembly;

the linear actuator screw being independently rotatable from the compact linear actuator and the linear actuator screw assembly;

the linear actuator screw assembly being jointly attached to the upper linear actuator bracket;

the upper arm bracket being connected to the top wall aligned and in parallel relationship to the upper linear actuator bracket;

the upper arms having first upper ends and second upper ends;

the upper arm bracket being jointly connected to the first upper ends;

the middle bracket being jointly connected to the upper arms adjacent to the first upper ends in a perpendicular relationship;

the middle bracket having a through hole;

the linear actuator screw nut being connected to the middle bracket and being concentrically aligned to the through hole;

the linear actuator screw being inserted through the through hole and the linear actuator screw nut;

the lower arms having a first lower ends and a second lower ends;

the lower arms being jointly connected to the upper arms by the first lower ends and the second upper ends, respectively;

the lower arms being jointly connected to the lower arm blocks at the second lower ends; and the compact linear actuator being activated to push or pull on the middle bracket to lift or lower the platen by means of the upper arms and the lower arms along the linear guide rails.

16. The waste compaction and lifting gate mechanism as claimed in claim 15 comprises, the platen being box shaped having two tapered edges and upper corners;

the mechanism chamber being a recessed space on the platen;

the lower plate being downwardly positioned on the platen;

the lower arm block being connected to the platen within the mechanism chamber;

the upper platen block being connected to the upper corners of the platen;

the L-shaped connectors being connected to the upper platen blocks;

the linear guide block being connected to the L-shaped connectors and positioned parallel with the linear guide rails; and the lower plate having V-shaped members arranged parallel relationship.

17. The waste compaction and lifting gate mechanism as claimed in claim 15 comprises, the waste receptacle being positioned in the waste chamber;

the side walls having a front side and a rear side;

the linear guide rails positioned on the side walls on the front side adjacent to the front door and on the rear side adjacent to the rear wall in parallel relationship; and the leveling feet connected to the bottom wall.

18. The waste compaction and lifting gate mechanism as claimed in claim 15 comprises, the upper gate bracket being connected to the gate positioning flag;

the upper linear guide bearing being connected to the upper bracket in parallel relationship;

the lower linear guide bearing being connected to the door frame in parallel relationship to the upper gate bracket;

the lower gate bracket being connected to the lower linear guide bearing;

the upper linear guide bearing and the lower linear guide bearing being latched to the gate linear guide;

the lower gate bracket being connected to the upper gate bracket by the gate safety device;

the gate connection bracket being jointly connected to the lower gate bracket;

the gate lever upwardly extending from the gate door;

the gate lever being jointly connected to the gate connection bracket;

the solenoid latch being connected to the door frame adjacent to and in parallel relationship to the upper gate bracket;

the locking pin bracket being connected to the door frame;

the locking pin being connected to the solenoid latch and inserted through the locking pin bracket;

the gate switch bracket being connected to the door frame adjacent to and in parallel relationship to the locking pin;

the gate close indicator switch being connected to the gate switch bracket;

the gate door being connected to the door frame by the gate hinge;

the lock bar connected to the gate door downwardly from the locking pin and the gate hinge;

the lock bar arranged in parallel relationship to the gate hinge;

the lock bar comprise of a lock hole;

the close flag being connected in perpendicular relationship to the lock bar and linear relationship to the gate close indicator switch;

the sensor bracket being connected to the door frame and arranged adjacent to the gate connection bracket;

the proximity sensor being connected to the sensor bracket; and the gate cover overlapping the gate door.

19. The waste compaction and lifting gate mechanism as claimed in claim 18 comprises, the gate linear actuator being activated to push or pull on the gate lever to lift or lower the gate door through the upper gate bracket, lower gate bracket, and gate connection bracket;

the gate safety device comprises a permanent magnet, a spring, a magnet housing, and a magnet screw;

the spring being enveloped about the magnet housing;

the permanent magnet being inserted into the magnet housing; and the magnet screw securing the permanent magnet to the magnet housing.

* * * * *